US007589756B2

(12) United States Patent
Matsumae et al.

(10) Patent No.: US 7,589,756 B2
(45) Date of Patent: Sep. 15, 2009

(54) OPTICAL SCANNING DEVICE, IMAGE FORMING APPARATUS, OPTICAL SCANNING CORRECTING METHOD, AND IMAGE FORMING METHOD

(75) Inventors: Iwao Matsumae, Tokyo (JP); Yoshinobu Sakaue, Tokyo (JP); Kazunori Bannai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 133 days.

(21) Appl. No.: 11/521,560

(22) Filed: Sep. 15, 2006

(65) Prior Publication Data

US 2007/0064087 A1 Mar. 22, 2007

(30) Foreign Application Priority Data

Sep. 16, 2005 (JP) ..... 2005-270093

(51) Int. Cl.
*B41J 15/14* (2006.01)
*B41J 2/435* (2006.01)
*B41J 27/00* (2006.01)

(52) U.S. Cl. ..... 347/241; 347/250; 347/256; 347/257; 347/258; 347/259; 347/260; 347/261

(58) Field of Classification Search ..... None
See application file for complete search history.

(56) References Cited

U.S. PATENT DOCUMENTS

| | | | | |
|---|---|---|---|---|
| 6,697,092 | B2 | 2/2004 | Bannai | |
| 6,786,590 | B2 | 9/2004 | Maki | |
| 6,836,633 | B2 | 12/2004 | Bannai | |
| 6,891,559 | B1 | 5/2005 | Bannai | |
| 2001/0017645 | A1* | 8/2001 | Toda | 347/116 |
| 2003/0067533 | A1* | 4/2003 | Omori et al. | 347/248 |
| 2003/0214694 | A1* | 11/2003 | Sakai | 359/206 |
| 2004/0041896 | A1* | 3/2004 | Shinohara | 347/116 |
| 2004/0100550 | A1 | 5/2004 | Bannai | |
| 2004/0263603 | A1 | 12/2004 | Maki | |
| 2005/0174418 | A1 | 8/2005 | Sakaue | |
| 2006/0055769 | A1 | 3/2006 | Yamazaki | |
| 2006/0164505 | A1* | 7/2006 | Maeda | 347/234 |

FOREIGN PATENT DOCUMENTS

| | | | |
|---|---|---|---|
| JP | SHO 63-300259 | A | 12/1988 |
| JP | 2543508 | B | 7/1996 |
| JP | 2740256 | B | 1/1998 |
| JP | 2748971 | B | 2/1998 |
| JP | 3087748 | B | 7/2000 |
| JP | 2000-235290 | A1 | 8/2000 |
| JP | 2001-117030 | A | 4/2001 |

(Continued)

*Primary Examiner*—Matthew Luu
*Assistant Examiner*—Kendrick X Liu
(74) *Attorney, Agent, or Firm*—Harness, Dickey & Pierce, P.L.C.

(57) ABSTRACT

A beam detecting unit detects at least one of a position of an optical beam in a sub scanning direction and a position of the optical beam in a main scanning direction. A color-misalignment correcting unit changes an optical-beam irradiating position on a photosensitive element based on a result of detection by the beam detecting unit. The beam detecting unit is arranged between an optical element that is closest to a corresponding photosensitive element and the corresponding photosensitive element.

14 Claims, 17 Drawing Sheets

FOREIGN PATENT DOCUMENTS

| | | | |
|---|---|---|---|
| JP | 2001-253113 | A | 9/2001 |
| JP | 2002-096502 | A | 4/2002 |
| JP | 2003-215482 | A | 7/2003 |
| JP | 2003-330243 | A | 11/2003 |
| JP | 2004-004191 | A | 1/2004 |
| JP | 2004-174720 | A | 6/2004 |
| JP | 2004-287380 | A | 10/2004 |

* cited by examiner

OPTICAL SCANNING DEVICE, IMAGE FORMING APPARATUS, OPTICAL SCANNING CORRECTING METHOD, AND IMAGE FORMING METHOD

CROSS-REFERENCE TO RELATED APPLICATIONS

The present document incorporates by reference the entire contents of Japanese priority document, 2005-270093 filed in Japan on Sep. 16, 2005.

BACKGROUND OF THE INVENTION

1. Field of the Invention

The present invention relates to an optical scanning device that irradiates an optical beam emitted from a light source and reflected by a deflector to a photosensitive element, to write electrostatic latent images, and relates to an image forming apparatus using the optical scanning device, an optical-scanning correcting method, and an image forming method.

2. Description of the Related Art

In a tandem type image forming apparatus that forms images of respective colors by one polygon motor simultaneously, positions and angles of optical elements slightly change due to heat generated by the polygon motor in the optical scanning device as an optical writing unit and due to environmental changes in the machine, thereby changing the scanning position of the optical beams with respect to the photosensitive elements. As a result, registration between colors, inclination of scanning lines between colors, and curvature of scanning lines between colors occur. These factors cause color misalignment of a color image to be synthesized. This phenomenon of the color misalignment is more particular in a sub scanning direction.

Accordingly, a method of providing a pattern image (a registration mark image) for detecting a misalignment amount in the sub scanning direction on a photosensitive drum or a transfer medium has been widely adopted. Thereby, the amount of color misalignment can be reduced based on the misalignment amount detected by a sensor from a pattern image transferred onto the transfer medium, for example.

According to this method, however, there is a problem that the pattern image is contaminated due to dust and dirt, since the misalignment pattern image is arranged near the photosensitive drum or the transfer medium (an intermediate transfer belt). Furthermore, when the photosensitive drum or the transfer medium is stained or foreign matter adheres thereon, the pattern image may not be written accurately. Detection may not be possible as a result, and even if detection can be made, the correction result may not be appropriate.

Accordingly, as means for solving this problem, there has been proposed a technique in which a sensor for detecting scanning positions of optical beams of respective colors is installed to detect fluctuations of mutual positions of respective beams, and the result thereof is reflected to the control of modulation timing of the optical beams, to correct color misalignment (for example, see Japanese Patent No. 3087748, Japanese Patent Application Laid-open Nos. 2000-235290 and 2004-287380).

However, in the technique for correcting color misalignment, since the optical beams reaching the sensor do not pass through an optical element to be passed at the time of writing an actual image, or pass through an optical element, through which the optical beams reaching a surface to be exposed do not pass (one for folding an optical path or for changing an imaging position), registration, which is considered to have been appropriately corrected based on the detection result of the sensor, may not be linked to an actual image.

SUMMARY OF THE INVENTION

It is an object of the present invention to at least partially solve the problems in the conventional technology.

An optical scanning device according to one aspect of the present invention is for an image forming apparatus that forms a color image by combining a plurality of single color images formed on a plurality of photosensitive elements. The optical scanning device includes a plurality of light sources each of which emits an optical beam; a deflecting unit that deflects optical beams from the light sources; a plurality of optical elements provided for each of the optical beams, sequentially arranged between the deflecting unit and the photosensitive elements, to guide the optical beams deflected by the deflecting unit to the photosensitive elements; a beam detecting unit provided for each of the optical beams for detecting at least one of a position of the optical beam in a sub scanning direction and a position of the optical beam in a main scanning direction; and a color-misalignment correcting unit provided for each of the optical beam for changing an optical-beam irradiating position on the photosensitive elements based on a result of detection by the beam detecting unit. The beam detecting unit is arranged between an optical element that is closest to a corresponding photosensitive element and the corresponding photosensitive element.

An image forming apparatus according to another aspect of the present invention includes a plurality of photosensitive elements on each of which an electrostatic latent image is formed by an optical scanning; an optical scanning device that includes a plurality of light sources each of which emits an optical beam, a deflecting unit that deflects optical beams from the light sources, a plurality of optical elements provided for each of the optical beams, sequentially arranged between the deflecting unit and the photosensitive elements, to guide the optical beams deflected by the deflecting unit to the photosensitive elements, a beam detecting unit provided for each of the optical beams for detecting at least one of a position of the optical beam in a sub scanning direction and a position of the optical beam in a main scanning direction, which is arranged between an optical element that is closest to a corresponding photosensitive element and the corresponding photosensitive element, and a color-misalignment correcting unit provided for each of the optical beam for changing an optical-beam irradiating position on the photosensitive elements based on a result of detection by the beam detecting unit; a developing unit that develops the electrostatic latent image formed on each of the photosensitive elements as a toner image; a transfer unit that transfers the toner image onto a recording medium; and a fixing unit that fixes the toner image formed on the recording medium.

An optical-scanning correcting method according to still another aspect of the present invention is for an optical scanning device that is used in an image forming apparatus that forms a color image by combining a plurality of single color images formed on a plurality of photosensitive elements. The optical scanning device includes a plurality of light sources each of which emits an optical beam; a deflecting unit that deflects optical beams from the light sources; a plurality of optical elements provided for each of the optical beams, sequentially arranged between the deflecting unit and the photosensitive elements, to guide the optical beams deflected by the deflecting unit to the photosensitive elements; and a beam detecting unit provided for each of the optical beams for detecting at least one of a position of the optical beam in a sub scanning direction and a position of the optical beam in a main scanning direction, which is arranged between an optical element that is closest to a corresponding photosensitive element and the corresponding photosensitive element. The optical-scanning correcting method includes providing a color-misalignment correcting unit for each of the optical beam; and changing including the color-misalignment correcting unit changing an optical-beam irradiating position on the photosensitive elements based on a result of detection by the beam detecting unit.

An image forming method according to still another aspect of the present invention includes changing an optical-beam irradiating position on at least one photosensitive element from among a plurality of photosensitive elements using an optical-scanning correcting method; forming a plurality of single color images on the photosensitive elements by scanning optical beams; and outputting a color image by combining the single color images formed on the photosensitive elements. The optical-scanning correcting method is for an optical scanning device that includes a plurality of light sources each of which emits an optical beam; a deflecting unit that deflects optical beams from the light sources; a plurality of optical elements provided for each of the optical beams, sequentially arranged between the deflecting unit and the photosensitive elements, to guide the optical beams deflected by the deflecting unit to the photosensitive elements; and a beam detecting unit provided for each of the optical beams for detecting at least one of a position of the optical beam in a sub scanning direction and a position of the optical beam in a main scanning direction, which is arranged between an optical element that is closest to a corresponding photosensitive element and the corresponding photosensitive element. The optical-scanning correcting method includes providing a color-misalignment correcting unit for each of the optical beam; and changing including the color-misalignment correcting unit changing the optical-beam irradiating position on the photosensitive elements based on a result of detection by the beam detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
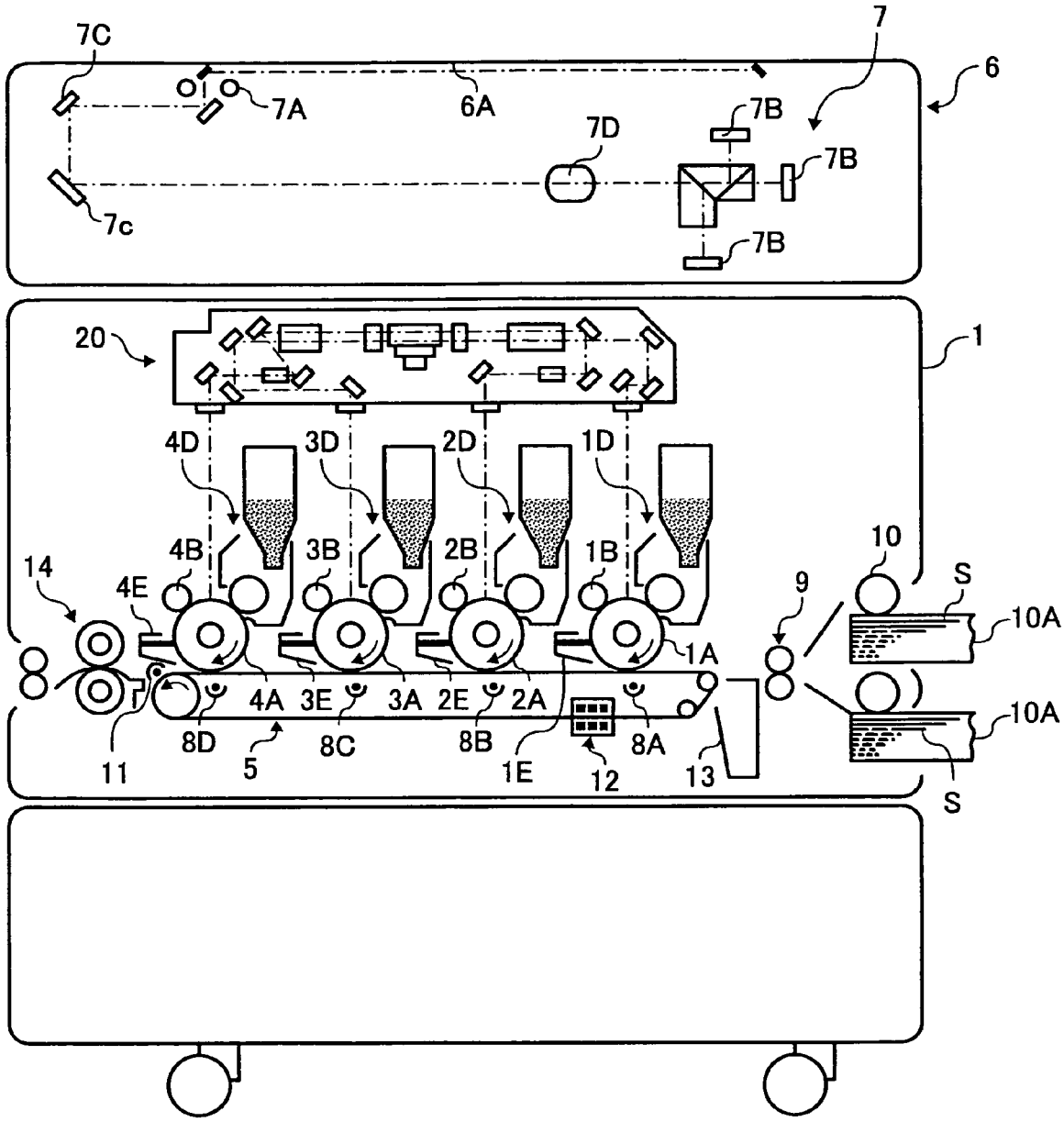
FIG. 1 is a schematic side view of an image forming apparatus according to the present invention.

FIG. 1 depicts an outline of an image forming apparatus 1 capable of forming a color image, to which the present invention is applied. While the image forming apparatus 1 is a copying machine, it can be other image forming apparatuses such as fax, printer, and multifunction product including a copying machine and a printer. When the image forming apparatus 1 is used as the printer or fax, image forming processing is performed based on an image signal corresponding to image information received from outside.

The image forming apparatus 1 can form an image on any of thick paper such as OHP sheets, cards, and postcards, and envelops other than standard paper generally used for copying, as a sheet recording medium S.

The image forming apparatus 1 adopts a tandem structure in which photosensitive drums (photosensitive elements) 1A, 2A, 3A, and 4A are arranged in juxtaposition with each other as a plurality of image carriers capable of forming a single color image corresponding to each color-separated color of yellow, cyan, magenta, and black. Visual images of colors different from each other formed on the respective photosensitive drums 1A, 2A, 3A, and 4A are respectively transferred and superposed on transfer paper S, which is a recording medium carried by a transfer belt 5 as a movable intermediate transfer body, while facing the respective photosensitive drums 1A, 2A, 3A, and 4A.

The configuration relating to the image forming processing is explained, taking an example of one photosensitive drum 1A and a peripheral configuration thereof. Since other photosensitive drums 2A to 4*a* have a similar configuration, reference numerals and letters corresponding to those added to the photosensitive drum 1A and the peripheral configuration thereof are added to the photosensitive drums 2A to 4A and the peripheral configuration thereof for convenience' sake, and detailed explanations thereof are omitted.

A charger 1B using a configuration of corotoron or scorotoron, an optical scanning device 20 using laser beams from a laser light source, a developing unit 1D, and a cleaning device 1E are arranged around the photosensitive drum 1A, respectively, for executing the image forming processing along a rotation direction indicated by arrow. The optical scanning device 20, to which the present invention is applied, will be explained in detail, with reference to FIG. 2 onward.

The arrangement of the developing units 1D to 4D is in an order that yellow, cyan, magenta, and black toners can be supplied from the right in an extensional part of the transfer belt 5 in FIG. 1. While a roller is used for the charger 1B in the example shown in FIG. 1, the charger 1B is not limited to a contact type using the roller, and a corona discharge type using a discharge wire can be also used.

In the image forming apparatus 1, a document reading unit 6 is arrange above the image forming unit in which the charger 1B, the optical scanning device 20, the developing unit 1D, and the cleaning device 1E are arranged, so that image information obtained by reading a document placed on a document table 6A by a reading unit 7 is output to an image processing controller (not shown), to obtain write information with respect to the optical scanning device 20.

The reading unit 7 includes a light source 7A for scanning the document placed on the document table 6A, a plurality of reflecting mirrors 7C and an imaging lens 7D for forming an image on a charge coupled device (CCD) 7B provided corresponding to each separated color by reflected light from the document. Image information corresponding to optical power for each separated color is output from the CCD 7B to the image processing controller.

The transfer belt 5 is a member having a thickness of 100 micrometers and formed of a dielectric such as a polyester film, spanned between a plurality of rollers. One of the extensional parts surfaces respective photosensitive drums 1A to 4A, and transfer units 8A, 8B, 8C, and 8D are respectively arranged inside of the position facing the respective photosensitive drums 1A to 4A. The thickness of the transfer belt 5 includes a manufacturing error of ±10 micrometers, and hence misalignment can occur when the toner images formed for respective colors are superposed. However, the misalignment is dissolved mainly by correction by a color misalignment write-start-position correcting unit 110 described later.

The recording medium S drawn out from a paper feed cassette 10A is fed to the transfer belt 5 via a pair of resist rollers 9, electrostatically attracted to the transfer belt 5 due to corona discharge from the transfer unit 8A and carried. The transfer units 8A, 8B, 8C, and 8D have characteristics such that these apparatuses use positive corona discharge to electrostatically attract an image respectively carried on the photosensitive drums 1A to 4A toward the recording medium S.

A separator 11 for recording medium S is arranged at a position where the recording medium S moves, onto which images from respective photosensitive drums 1A to 4A have been transferred, and dischargers 12 are arranged at the other of the extensional parts, facing each other putting the transfer belt therebetween. In FIG. 1, reference numeral 13 denotes a cleaning device that removes toner remaining on the transfer belt 5.

The separator 11 neutralizes electric charges accumulated on the recording medium S by performing negative AC corona discharge from above of the recording medium S, to release the electrostatically attracted state, thereby enabling separation using a curvature of the transfer belt 5, and also prevents occurrence of toner scattering due to peeling discharge at the time of separation. The discharger 12 neutralizes the accumulated electric charges on the transfer belt 5 by performing negative AC corona discharge, which is a reversed polarity of the charging characteristics by the transfer units 8A to 8D, from two sides of the transfer belt 5, to perform electrical initialization.

On the respective photosensitive drums 1A to 4A, the surfaces of the photosensitive drums 1A to 4A are uniformly charged by the chargers 1B to 4B, an electrostatic latent image is respectively formed on each photosensitive drum by writing units 1C to 4C, based on the image information for each separated color read by the reading unit 7 in the document reading unit 6, and turned into a visual image by a color toner having a complementary relation with respect to the separated color supplied from the developing units 1D to 4D. The electrostatic latent images are then electrostatically transferred onto the recording medium S carried by the transfer belt 5 via the transfer units 8A to 8D.

The recording medium S including an image (a single color image) for each separated color carried on the respective photosensitive drums 1A to 4A and transferred thereon is discharged by the discharger 12, self-stripped by using the curvature of the transfer belt 5, shifted to a fixing unit 14 so that the toner in an unfixed image is fixed, and then ejected onto a paper ejection tray (not shown) outside of the image forming apparatus 1.

Figure 2:
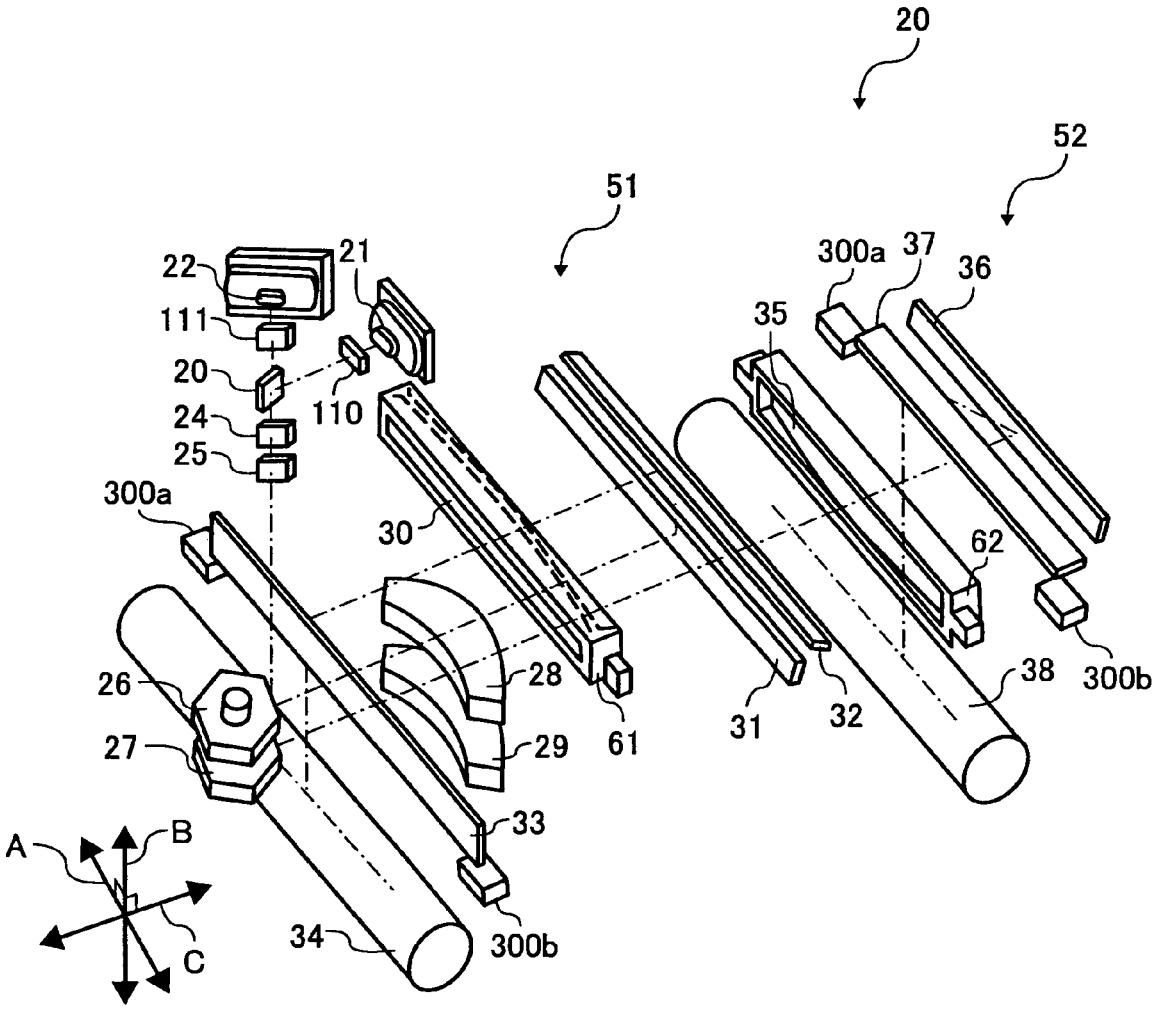
FIG. 2 is a schematic diagram of a configuration of an optical scanning device according to the present invention.

As shown in FIG. 2, the optical scanning device 20 is a tandem type writing optical system. FIG. 2 depicts an outline of the optical scanning device 20, which employs a scanning lens method, and can correspond to either of the scanning lens method and a scanning mirror method. In FIG. 2, two stations are shown and explained for convenience of drawing. However, four stations can be accommodated by having a symmetric arrangement, centering on polygon mirrors 26 and 27 as a deflector. This configuration is used for the image forming apparatus 1. Since the image forming apparatus 1 can form a color image as in the present embodiment, when the image forming apparatus is to form a color image, the optical scanning device 20 is used for forming a color image.

The optical scanning device 20 includes two LD units 21 and 22 as a light source. The optical scanning device 20 irradiates laser beams respectively emitted from the LD units 21 and 22 to respective photosensitive drums 34 and 38 as image carriers to form an image, and for this purpose, includes optical element groups 51 and 52 formed of a plurality of optical elements, respectively, corresponding to the LD units 21 and 22 and the photosensitive drums 34 and 38. As a result, the optical scanning device 20 is arranged in correspondence with the photosensitive drums 34 and 38, respectively. The photosensitive drums 34 and 38 correspond to either one of the photosensitive drums 1A to 4A.

The optical element group 51 is formed of a plurality of optical elements, that is, a prism (a conventional write-start-position correcting unit 110), a folding mirror 23, a cylindrical lens 24, a polygon mirror 26, a first scanning lens 28, folding mirrors 31 and 32, a second scanning lens 30, and a folding mirror 33. The optical element group 52 is formed of a plurality of optical elements, that is, a prism (a write start position-correcting unit 111 described later), a cylindrical lens 25, a polygon mirror 27, a first scanning lens 29, a second scanning lens 35, and folding mirrors 36 and 37.

The optical scanning device 20 further includes a holding member 61 for holding the second scanning lens 30 of the optical elements constituting the optical element group 51, and a holding member 62 for holding the second scanning lens 35 of the optical elements constituting the optical element group 52. The holding member 61 and the second scanning lens 30 as the optical element to be held by the holding member 61 have substantially the same configuration as that of the holding member 62 and the second scanning lens 50 as the optical element to be held by the holding member 62.

The LD units 21 and 22 are arranged at different heights in a sub scanning direction B, which is substantially a perpendicular direction. The beam emitted from the upper LD unit 21 passes through the write-start-position correcting unit 110, and is bent in the same direction as the beam emitted from the lower LD unit 22 by the folding mirror 23 placed in the middle of the course. The beam emitted from the lower LD unit 21 passes through the write start position-correcting unit 111 before entering into the folding mirror 23, and passes through the folding mirror 23. Thereafter, the beam from the LD unit 21 and the beam from the LD unit 22 respectively enter into the cylindrical lens 24, 25, and are respectively condensed linearly near a reflecting surface of the upper or lower polygon mirror 26, 27 away from each other by a predetermined distance.

The LD units 21 and 22 respectively have at least a semiconductor laser and a collimate lens, although not shown. The write start position-correcting units 110 and 111 respectively have a wedge-shaped prism (not shown) as a light refracting member, and the beams emitted from the LD units 21 and 22 pass through respective prisms at the time of passing through the write start position-correcting units 110 and 111. The polygon mirrors 26 and 27 are directly connected to a polygon motor (not shown) and rotated.

The beams deflected by the polygon mirrors 26 and 27 are respectively subjected to beam forming by the first scanning lenses 28, 29, which are formed integrally or superposed in two stages, and then to beam forming by the second scanning lenses 30 and 35 into a predetermined beam spot diameter so as to have fθ characteristics, and scan the surfaces of the photosensitive drums 34 and 38. After passing the first scanning lenses 28 and 29, the optical paths of the beams are made different so as to guide the beams to two different photosensitive drums 34 and 38.

The upper beam, that is, the beam having passed the first scanning lens 28 is directed upward by 90 degrees by the folding mirror 31, and bent by 90 degrees by the folding mirror 32 to enter into the second scanning lens 30, which is an upper long plastic lens, and are bent perpendicularly downward in the direction B by the folding mirror 33, so as to scan on the photosensitive drum 34 in a main scanning direction A, which is a scanning direction of the beam.

The lower beam, that is, the beam having passed the first scanning lens 29 enter into the second scanning lens 35, which is a lower long plastic lens without entering into the folding mirror, the optical path of which is bent by two folding mirrors 36 and 37, so as to scan on the photosensitive element 38 having a predetermined drum pitch in the main scanning direction A of the beam. In FIG. 2, arrow C indicates a direction of optical axis of the second scanning lenses 30 and 35.

Beam-spot position detectors 300*a* and 300*b*, which are beam detectors having a function as a misalignment detector that detects the beam positions, are arranged between the folding mirror 33, which is closest to the photosensitive element among the optical element group 51, and the photosensitive drum 34. Further, the beam-spot position detectors 300*a* and 300*b* are also arranged between the folding mirror 37, which is closest to the photosensitive element among the optical element group 52, and the photosensitive element 38.

Figure 3:
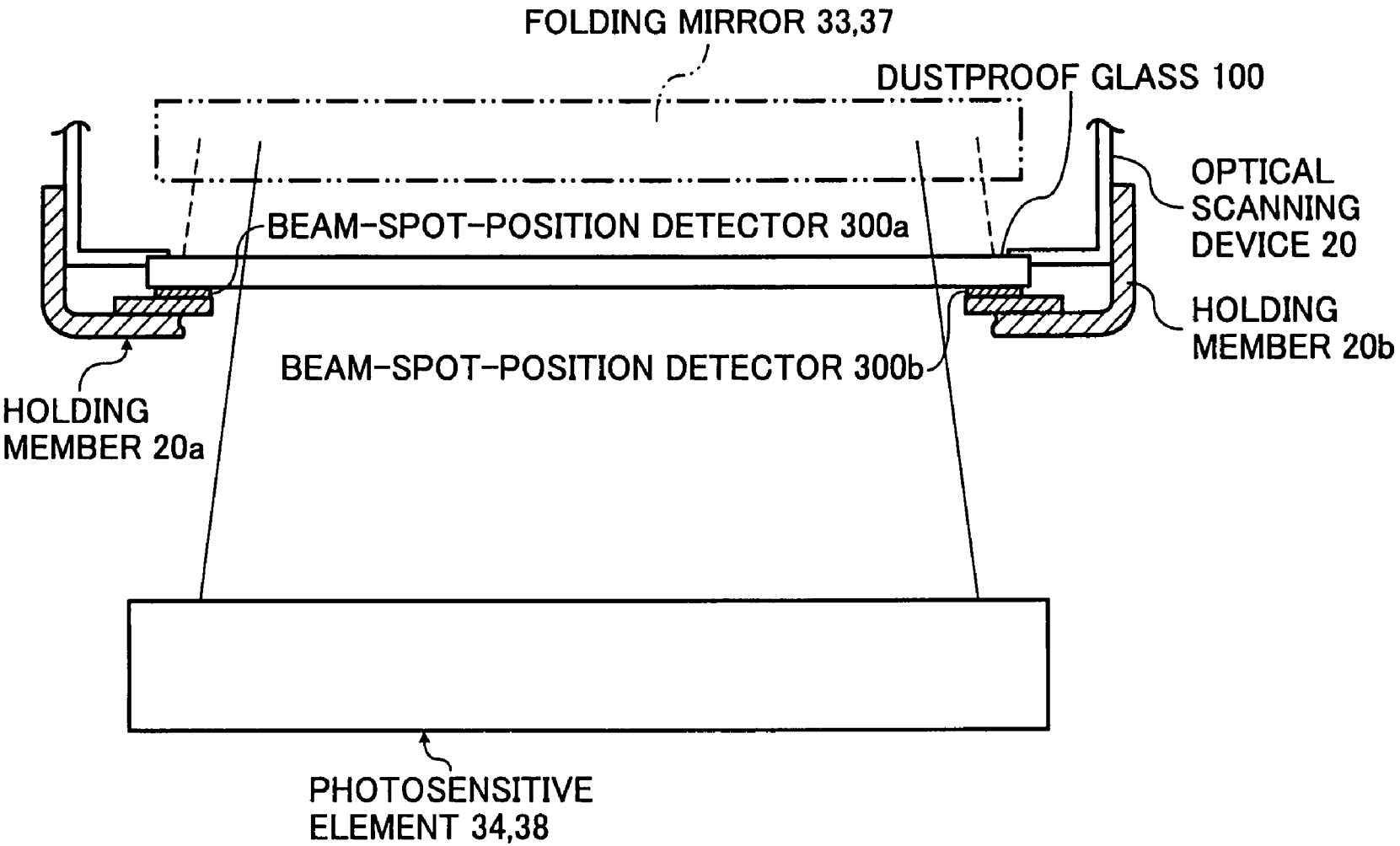
FIG. 3 is a schematic diagram of an arrangement of beam detectors.

FIG. 3 depicts a detailed arrangement of the beam-spot position detectors 300*a* and 300*b*. The beam-spot position detectors 300*a* and 300*b* are arranged at positions at which beam positions can be measured by commonly operating all optical elements such as lenses and reflecting mirrors, to achieve correlation between the beam position irradiated to the photosensitive drum 34 (or 38) and the detector. In other words, the position of the beam irradiated to the photosensitive drum 34 (or 38) can be directly detected by the beam-spot position detector 300*a* or 300*b* without passing through other optical elements.

In FIG. 3, the beam-spot position detectors 300*a* and 300*b* are integrally fitted to a housing of the optical scanning device 20 corresponding to optical beams of respective colors, and are put between coupling brackets 20*a*, 20*b* as holding members and a dustproof glass 100 through which the beams are transmitted, and fixed. The beam from the folding mirror 33 or 37 is transmitted through the dustproof glass 100. The beam-spot position detectors 300*a* and 300*b* are arranged on the scanning line of the beam so that beams in an effective image area are irradiated to the photosensitive drum 34 or 38; however, beams outside the effective image area are made to enter into the beam-spot position detectors 300*a* and 300*b*. Since it can be considered that beam position fluctuations due to the dustproof glass 100 hardly occur, the beam-spot position detectors 300*a* and 300*b* can be arranged this side (the folding mirror 33 (or 37) side) of the dustproof glass 100.

The beam-spot position detector 300*a* is for detecting a write start position, and the beam-spot position detector 300*b* is for detecting a write finish position. More specifically, the beam-spot position detector 300*a* becomes at least one of a main scanning synchronization detector and a sub scanning beam position detector, to detect at least one of main scanning synchronization and sub scanning detection of beams. The beam-spot position detector 300*b* can measure at least one of main scanning magnification as the optical scanning device and inclination of scanning lines.

In other two stations not shown in FIG. 2, since the scanning direction of the beams becomes relatively opposite, write start and write finish relating to detection of the beam position by the beam-spot position detectors 300*a* and 300*b* become opposite. That is, in two stations out of four, scanning is started from the left of the image (a running direction is assumed to be upward), and in the remaining two stations, scanning is started from the right.

When a plurality of images are continuously printed, the temperature inside of the image forming apparatus 1 abruptly changes due to heat generation from the polygon motor for driving the polygon mirrors 26 and 27 and the LD units 21 and 22 inside of the optical scanning device 20, and heat from a heater at the time of fixing the toner image in the fixing unit 14 outside of the optical scanning device 20. In this case, the beam spot positions on the photosensitive drums 1A to 4A suddenly change, and hue of output color images gradually changes in the first print, several prints later, and after printing several tens.

Therefore, the beam-spot position detectors 300*a* and 300*b* are used as the misalignment detector (beam detector), to perform correction by a color-misalignment correcting unit described later. The beam-spot position detectors 300*a* and 300*b* as the misalignment detector are formed of a non-parallel photo diode sensor. The beam-spot position detectors 300*a* and 300*b* also have a function of detecting a synchronization signal for determining the write start position in the main scanning direction.

Figure 4:
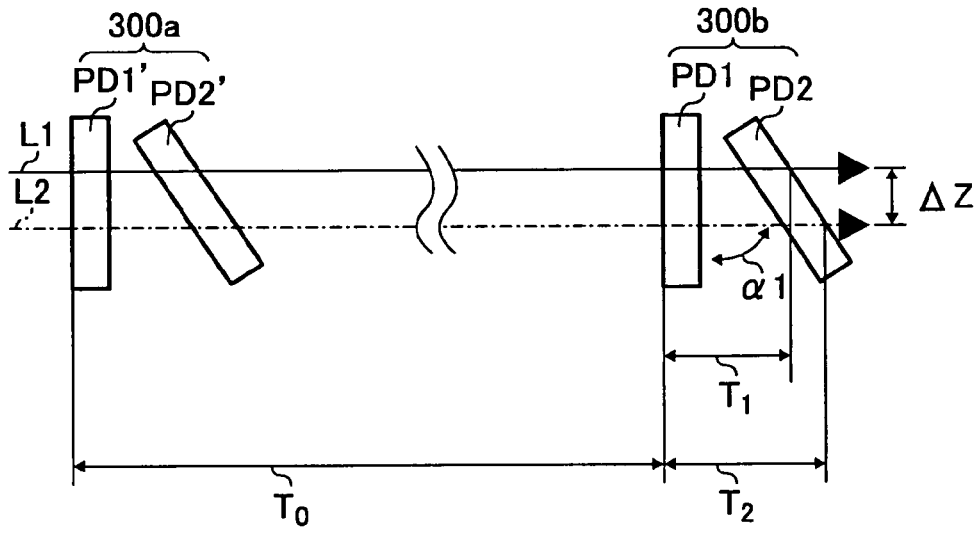
FIG. 4 is a schematic diagram for explaining principle of detection performed by a nonparallel photo diode sensor as a beam detector (a beam-spot position detector)
Figure 4:
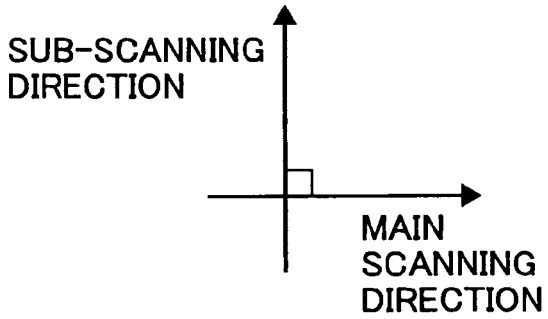

As shown in FIG. 4, light-receiving surfaces of photo diodes PD1 and PD1' are orthogonal to the scanning beams, and light-receiving surfaces of photo diodes PD2 and PD2' are inclined with respect to the light-receiving surfaces of the photo diodes PD1 and PD1'. This angle of inclination is designated as $\alpha 1$. It is assumed that when the scanning beam before the temperature change due to the heat of the heater is designated as L1, and the scanning beam after the temperature change is designated as L2, the scanning beam after the temperature change is shifted in the sub scanning direction by $\Delta Z$ (unknown). In this case, the scanning position in the sub scanning direction, that is, the write start position is monitored and detected by measuring time T1 and T2, at which the scanning beams L1 and L2 pass through between a pair of non-parallel photo diodes, that is, between the non-parallel photo diodes PD1 and PD2, or between the non-parallel photo diodes PD1' and PD2', to determine a time difference T2−T1.

A relative dot misalignment in the sub scanning direction, that is, a correction amount $\Delta Z$ in the sub scanning direction can be easily obtained by calculation, since the angle $\alpha 1$ between respective light-receiving surfaces of the PD1 and PD2, and the time difference T2−T1 are known. The correction amount is corrected by the write-start-position correcting unit 110. Therefore, when a plurality of images are to be printed out continuously, even if the beam spot positions on the photosensitive drums 1A to 4A suddenly change due to a temperature change or the like, the beam spot positions on the photosensitive drums 1A to 4A can be corrected even during the write of the image data. A magnification change in the main scanning direction can be also monitored by detecting a variation of time T0 required for the scanning beams to pass through between the photo diodes PD1' and PD1. In FIG. 4, the beam-spot position detectors 300*a* and 300*b* using the photo diode are shown. However, any other light-receiving elements, such as a line CCD, can be used so long as the beam position can be detected.

Thus, by performing measurement at two positions for each beam, not only the magnification but also the write position on one end in the main scanning direction based on the image carrier can be directly measured for each beam (regardless of scanning front end or rear end).

The single color image can be corrected by various color-misalignment correcting units based on a detection result obtained by the beam-spot position detectors 300*a* and 300*b*. The details thereof are explained below.

In the case of tandem type in which images of respective colors are formed simultaneously by one polygon motor, when adjustment of the single color image (registration) between respective colors is performed at write timing, the adjustment is possible only by the scanning time interval of one surface of the polygon mirror, and hence color misalignment of one line at maximum occurs. Further, since the positions and angles of respective optical elements change slightly due to heat generation of the polygon motor in the optical scanning device, the scanning position on the photosensitive element in the sub scanning direction changes, thereby causing color misalignment. Thus, the change in registration between colors (relative deviation between single color images of respective colors (relative deviation)) largely changes due to the temperature, thereby causing degradation of the image.

As a color misalignment correction method, an apparatus that forms a pattern for detecting color misalignment on a transfer member or the like, detects this pattern by a read sensor to measure a color misalignment amount, and adjusts image write timing to reduce color misalignment has been already proposed. In other words, according to this correction method, color misalignment resulting from slight changes in the position and the size of respective image forming units, and in the positions and sizes of parts in the image forming units due to a temperature change in a color image forming apparatus or an external force applied to the apparatus is detected and corrected. However, to ensure the calculation amount of color misalignment, a plurality of patterns are measured to take an average thereof, and hence certain time is necessary and the toner is consumed uselessly. Therefore, this method cannot be executed for each printout, and is only performed once for about 200 sheets of printout. At this execution timing, as described above, registration between colors is gradually shifted due to heat generation of the polygon motor, thereby causing degradation of the image. At the time of measuring color registration, in the case of a conventional write unit using one polygon motor, the registration can be adjusted only in a unit of one scanning line, and hence if it is between two colors, registration can be shifted by ½ line, and if it is for three colors or more, registration can be shifted by ¾ line.

According to the present invention, therefore, beams irradiated from the optical scanning device are accurately detected by arranging the beam-spot position detectors 300*a* and 300*b* as a sub scanning beam position detector at a beam emitting position, and color misalignment between colors is corrected temporarily by performing control using a deflecting element that changes the beams in the sub scanning direction.

Figure 5:
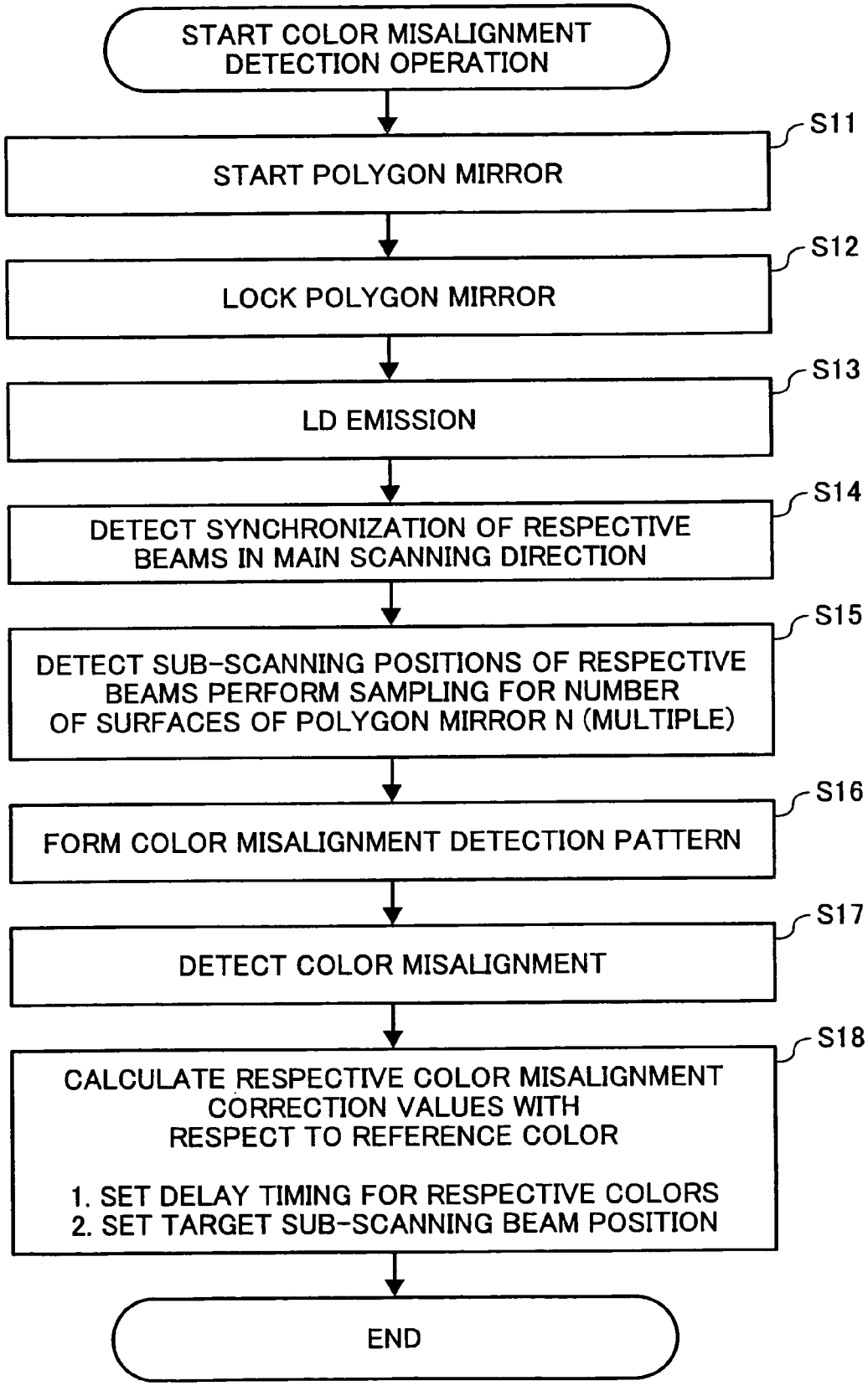
FIG. 5 depicts a procedure from the beginning of a color misalignment detection operation to calculation of a color misalignment correction value in relative deviation correction in a sub scanning direction of single color images of respective colors.

FIG. 5 is an example of a correction procedure. At the time of starting color misalignment detection pattern operation, after detecting main scanning synchronization of respective beams (S14), beam positions in the sub scanning direction are measured by the beam-spot position detectors 300*a* or sensors in the beam-spot position detectors 300*a* and 300*b* (S15). Since optical surface tangle of the mirror is different in one rotation of the polygon mirror, in other words, optical surface tangle slightly changes for each surface, and there is a difference due to a read error of the sensor, the number of measurement is determined to be the number of surfaces of the polygon mirror (one rotation)×n (multiple), thereby enabling accurate measurement of an average position.

The measured beam positions in the sub scanning direction and color misalignment patterns of respective colors are read (S17), to calculate a correction amount of respective color misalignment with respect to a reference color (S18). More specifically, the beam position and time in a single color image of the reference color (for example, black) is designated as a reference, and write timing delay time of respective colors (colors other than the reference color, in this case, yellow, cyan, and magenta) and a set value of the beam position in the sub scanning direction of the write unit are calculated and stored in a memory. The set value of the beam position in the sub scanning direction is a value obtained by calculating the measured sub scanning beam position and color misalignment, and adding a correction value less than one line thereto.

Figure 6:
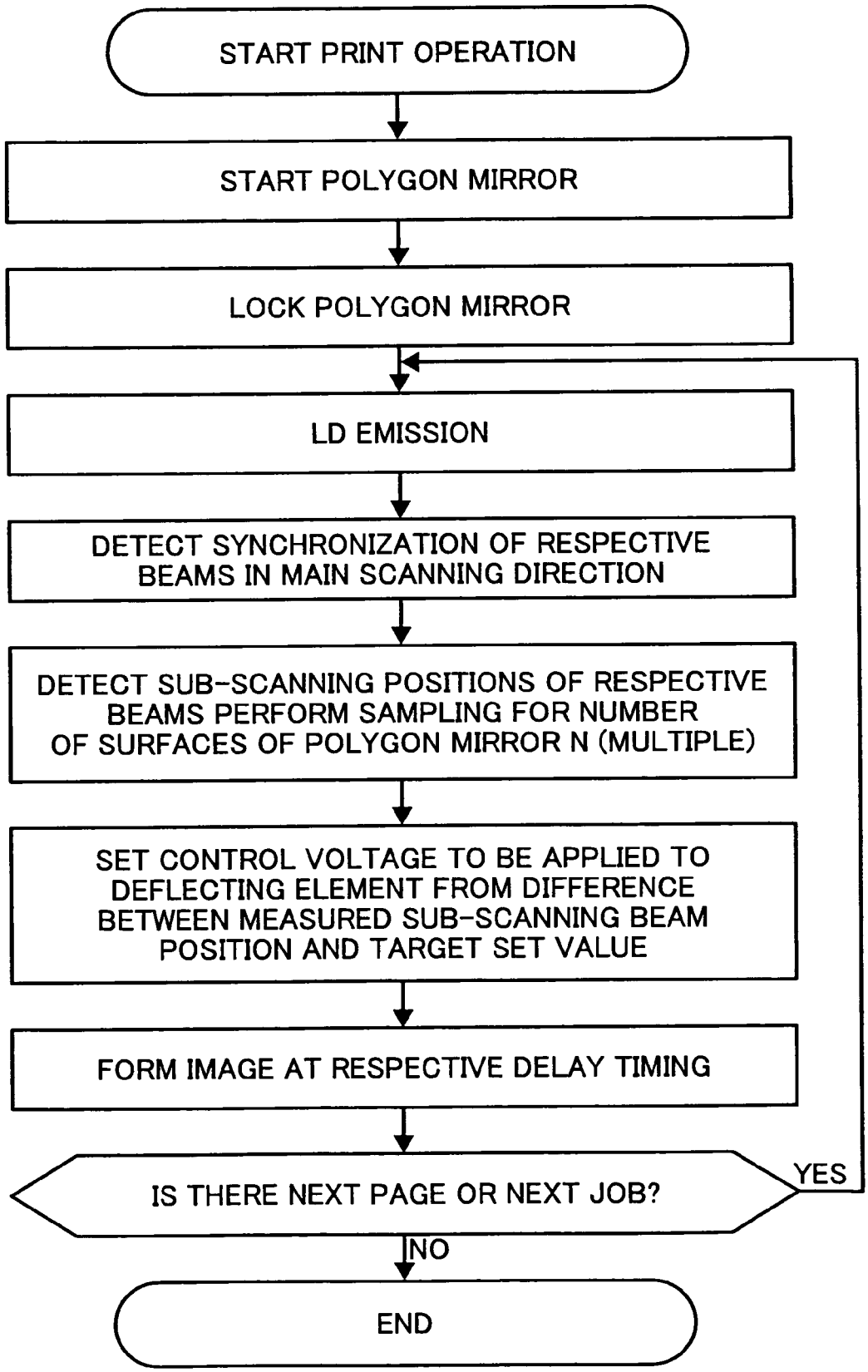
FIG. 6 depicts a procedure after starting printing operation in relative deviation correction in the sub scanning direction of single color images of respective colors.
Figure 7:
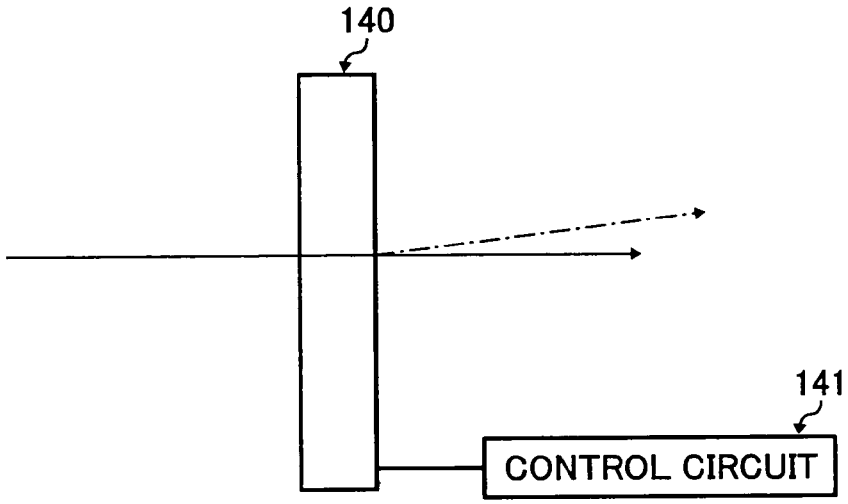
FIG. 7 is a schematic diagram of a basic configuration of a color-misalignment correcting unit formed of a liquid-crystal optical element.

Thereafter, at the time of normal printing operation, the sub scanning beam position of the optical scanning device is measured as shown in FIG. 6 and compared with a set value of the sub scanning beam position stored in the memory, and the sub scanning beam position is corrected so as to be matched with the position of the set value by the color-misalignment correcting unit described later. For example, when the color-misalignment correcting unit is a beam deflecting element, voltage is applied to the deflecting element so that the sub scanning beam position is matched with the position of the set value. This control voltage Vr needs only to be set to a certain voltage in one print, and prior to printing the next page, the sub scanning beam position is re-measured in the similar manner, to correct the voltage applied to the deflecting element, thereby performing the print operation. In the case of a continuous print job, the control voltage Vr of the deflecting element can be controlled by a certain value.

At the time of correcting the relative deviation in the sub scanning direction of the single color image by the color-misalignment correcting unit, the correction can be performed in a unit of one scan of the deflector, or in a unit of resolution finer than one scan of the deflector.

The relative deviation correction amount of the single color image in the sub scanning direction can be calculated based on a detection result by any one of the beam-spot position detectors 300*a* and 300*b*, or can be calculated from a mean value of two misalignment amounts detected respectively by the beam-spot position detectors 300*a* and 300*b*.

Figure 8:
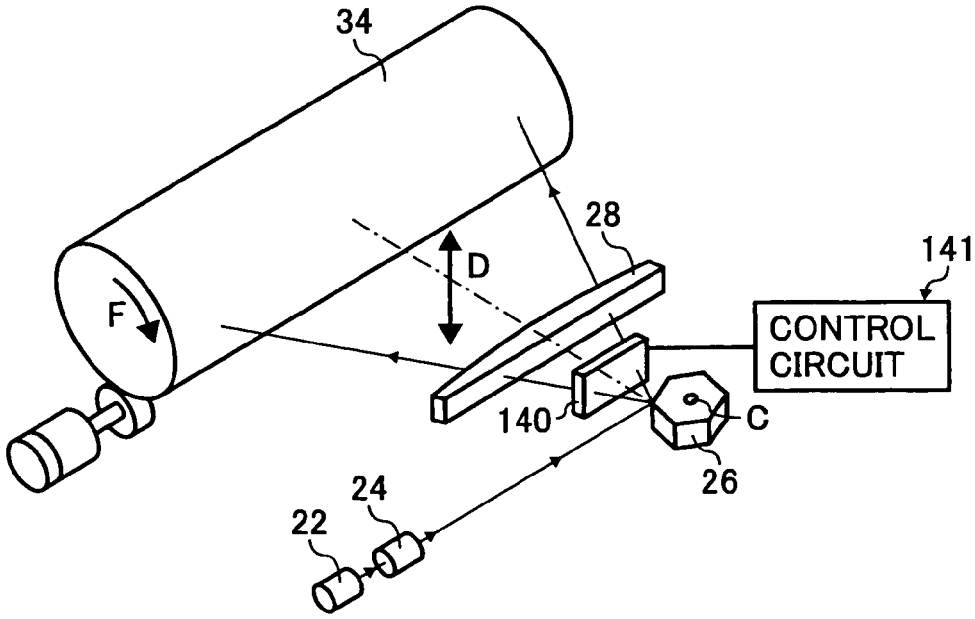
FIG. 8 is a schematic diagram of a configuration of relevant parts of the optical scanning device including a color-misalignment correcting unit.

FIGS. 7 to 10 depict a configuration example (1) of the color-misalignment correcting unit. A combination (FIG. 7) of a liquid-crystal optical element 140 formed of liquid crystals and a control circuit 141 that applies voltage to the liquid-crystal optical element 140 is used, and the liquid-crystal optical element 140 is arranged between a light source that emits optical beams and a deflector or between the deflector and a scanning lens. For example, as shown in FIG. 8, the arrangement of a part of components of the optical scanning device 20 (LD unit 22, cylindrical lens 24, polygon mirror 26, liquid-crystal optical element 140, control circuit 141, and first scanning lens 28) is shown, and the liquid-crystal optical element 140 is arranged between the polygon mirror 26 and the first scanning lens 28. The beam position of the optical beams deflected to scan by the polygon mirror 26 can be corrected in a direction D in the figure (in the sub scanning direction).

Figure 9:
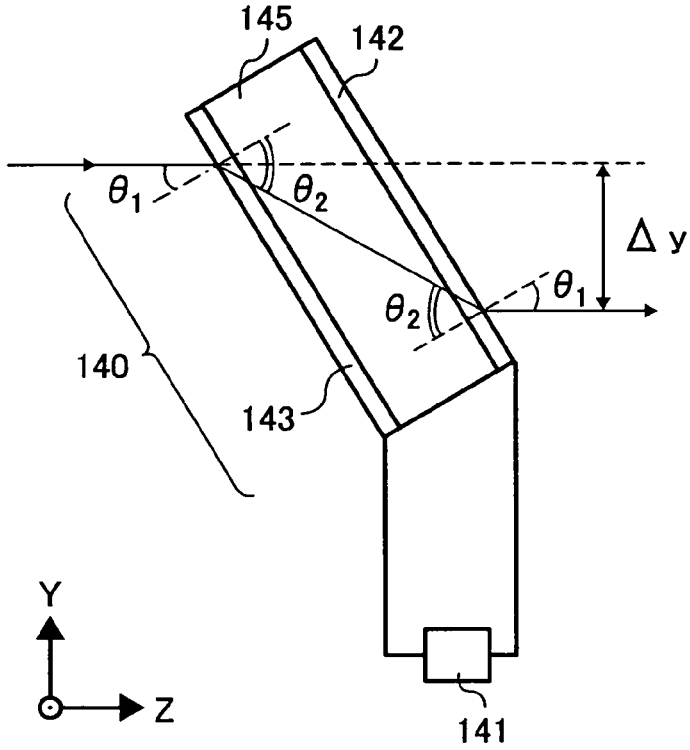
FIG. 9 is an explanatory diagram of a prism effect of the liquid-crystal optical element.

An example of the liquid-crystal optical element 140 includes, as shown in FIG. 9, the one formed of substrates 142 and 143 having an electrode and a liquid crystal layer 145. By applying a predetermined voltage difference to the electrode from the control circuit 141, a prism effect is generated in the liquid crystal layer 145, and by parallel-shifting the incident beams to a predetermined position, the beam position can be corrected in the sub scanning direction.

Figure 10:
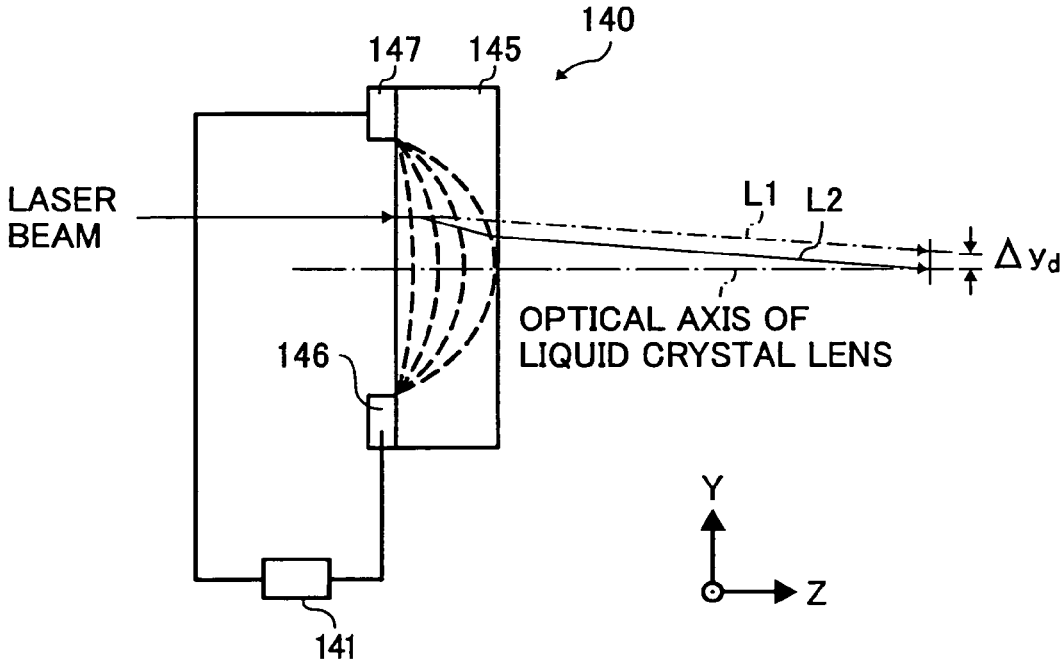
FIG. 10 is an explanatory diagram of a lens effect of the liquid-crystal optical element.

As another example of the liquid-crystal optical element 140, as shown in FIG. 10, there is the one formed of the liquid crystal layer 145 and electrodes 146 and 147 provided on the beam incoming side of the liquid crystal layer 145. By applying a predetermined voltage difference to the electrode from the control circuit 141, a lens effect of a convex lens is generated, and by refracting the beams, the beam position can be corrected in the sub scanning direction.

Figure 11:
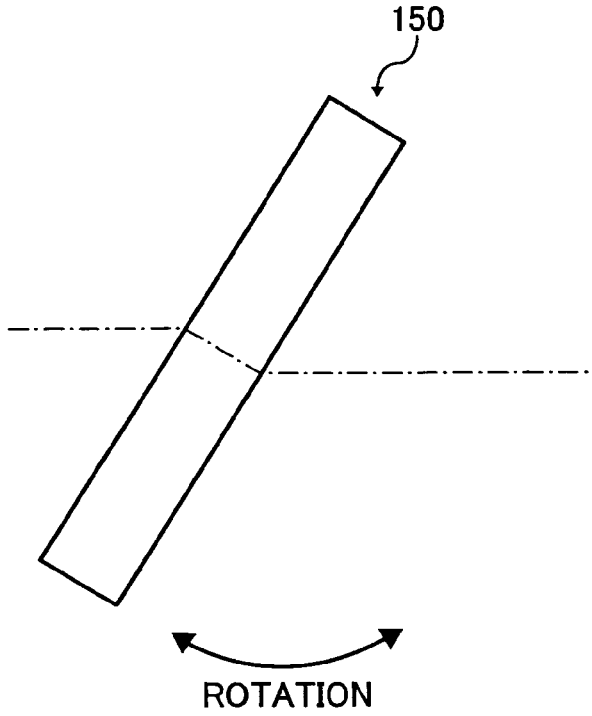
FIG. 11 is a schematic diagram of a parallel plate that constitutes a color-misalignment correcting unit.

FIGS. 11 to 14 depict a configuration example (2) of the color-misalignment correcting unit. This configuration uses a color-misalignment correcting unit disclosed in Japanese Patent Application Laid-Open No. 2004-4191 is used. That is, a parallel plate 150 that transmits optical beams, installed rotatably about an axis parallel to a main scanning axis is used, and the parallel plate 150 is arranged between the light source that emits optical beams and the deflector or between the deflector and the scanning lens. The beam position in the sub scanning direction can be corrected by allowing the optical beams to enter into the parallel plate 150 inclined due to the rotation (FIG. 11).

Figure 12:
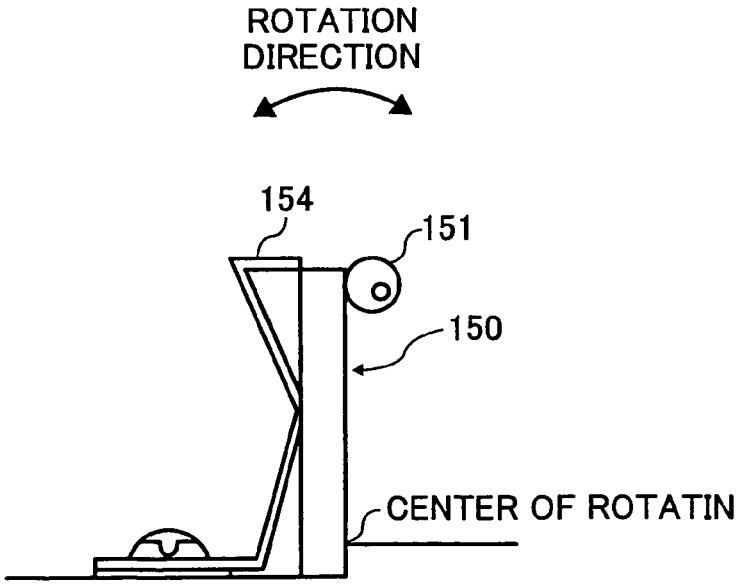
FIG. 12 is a sectional view of the color-misalignment correcting unit formed of the parallel plate.
Figure 13:
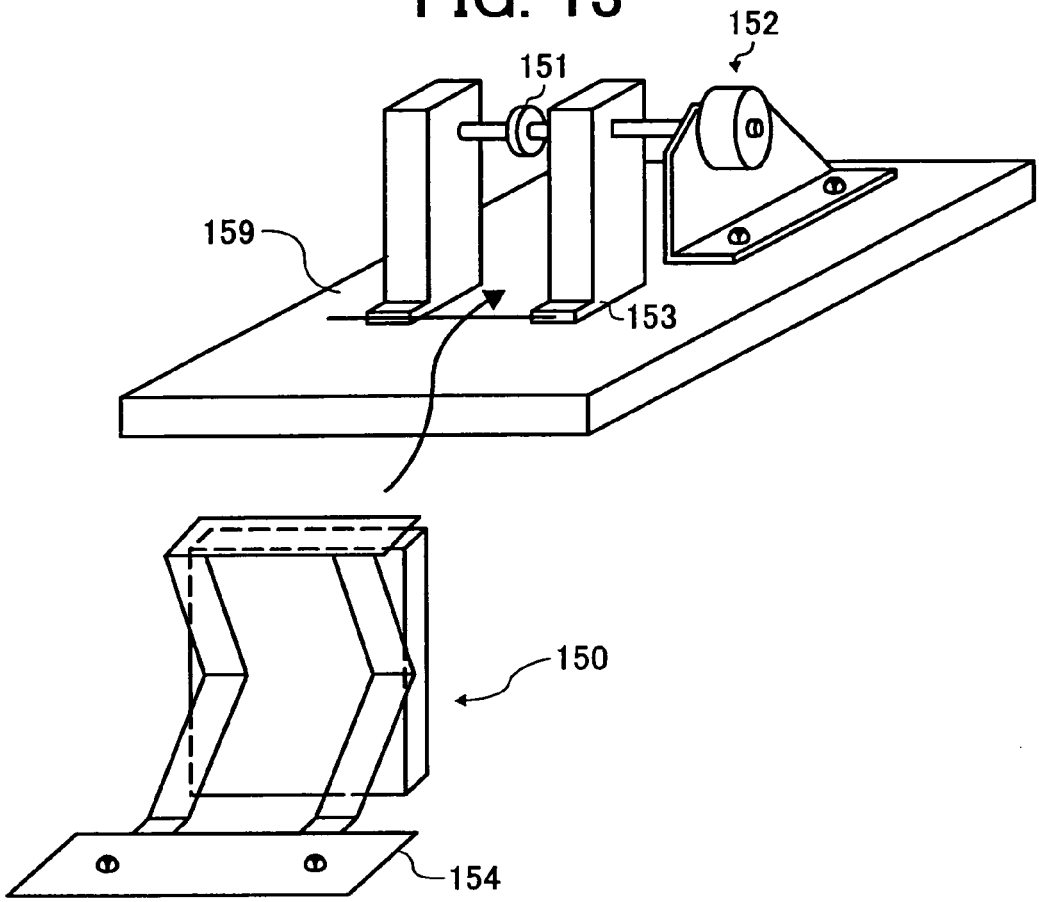
FIG. 13 is a perspective view of the color-misalignment correcting unit formed of the parallel plate.

FIG. 12 is a cross section of the color-misalignment correcting unit including the parallel plate, and FIG. 13 is a perspective view of the color-misalignment correcting unit.

The color-misalignment correcting unit includes an eccentric cam 151, an actuator 152 such as a stepping motor, a parallel plate-abutting surface 153, a plate spring 154, a rotation axis 159, and the parallel plate 150.

The parallel plate 150 abuts against protrusions of a receiving part at two lower parts, and is pressurized by the plate spring 154 from the opposite side, with the upper side thereof being fixed by the eccentric cam 151. The actuator 152 is fitted to the eccentric cam 151, and the eccentric cam 151 rotates due to rotation of the actuator 152 to move the upper abutting position of the parallel plate 150, whereby the parallel plate 150 rotates in a direction of arrow. At this time, the center of rotation becomes an axis passing through the lower abutting surfaces (two places). The center of rotation may not be on the optical axis.

Figure 14:
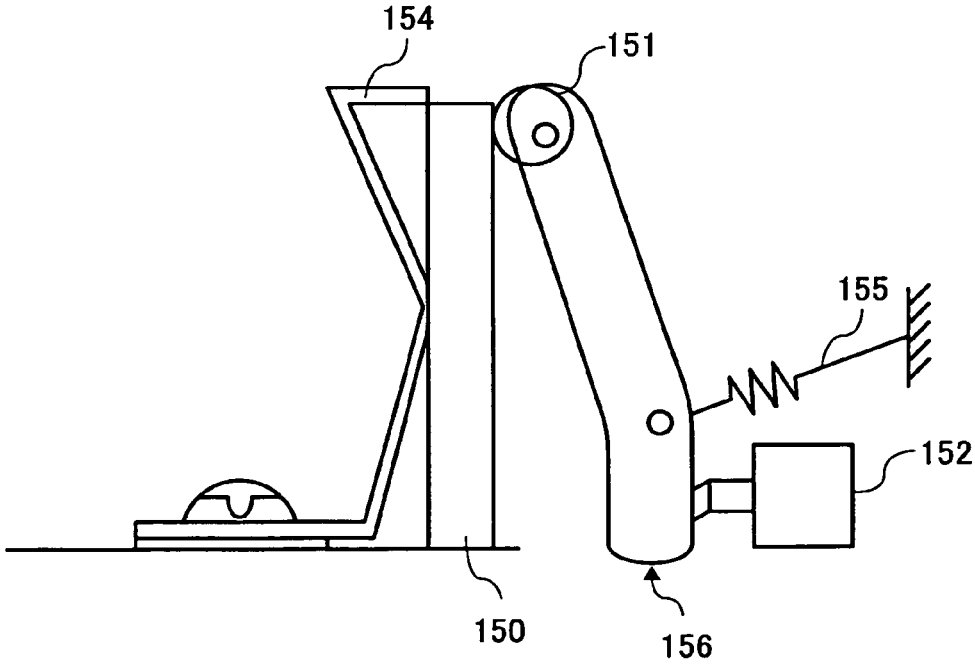
FIG. 14 is a schematic diagram of a state where a filler is provided on an eccentric camshaft of the parallel plate constituting the color-misalignment correcting unit.

FIG. 14 depicts a configuration in which a filler is provided on the eccentric cam shaft. In this case, the filler is fitted to the eccentric cam shaft, and the eccentric cam 151 is rotated by moving the filler, thereby to rotate the parallel plate 150.

The optical beam incident to the inclined parallel plate 150 is shifted in the sub scanning direction in parallel with the incident optical beam and emitted, by any one of these color-misalignment correcting units, and an amount of imperfect alignment thereof increases in proportion to the angle of rotation of the parallel plate 150.

Figure 15:
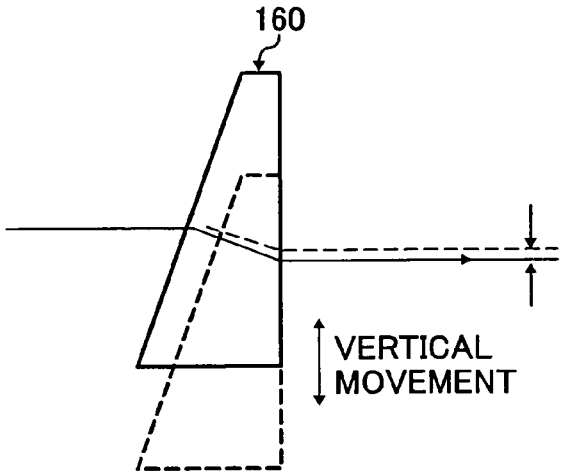
FIG. 15 is a schematic diagram of a basic configuration of a color-misalignment correcting unit formed of a prism.

As shown in FIG. 15, a prism 160 having a trapezoidal sectional shape can be arranged instead of the parallel plate 150, to correct the sub scanning beam position by parallel-shifting the prism 160 to a predetermined position in the sub scanning direction (vertical direction in the figure). The configuration of the actuator around the prism 160 can be the one using the actuator of the parallel plate.

Figure 16:
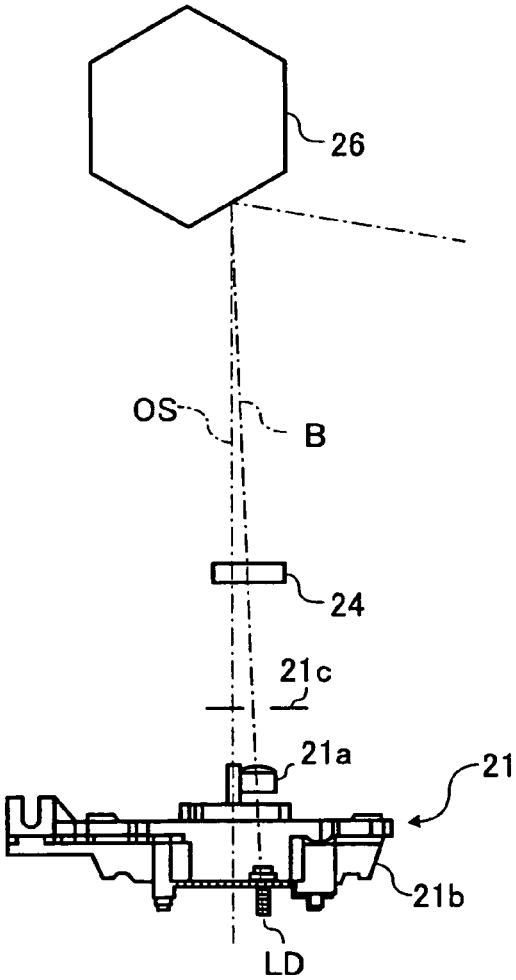
FIG. 16 is an enlarged plan view of a laser diode (LD) unit and a polygon mirror in the optical scanning device.

FIGS. 16 to 19 depict a configuration example (3) of the color-misalignment correcting unit. This configuration uses a color-misalignment correcting unit disclosed in Japanese Patent Application Laid-Open No. 2003-330243. That is, as shown in FIG. 16, a laser light-emitting diode LD as the LD unit (optical element unit) 21 is held by a holding member 21*b* together with a collimating lens 21*a*, which is a coupling optical system, and optical beams B emitted from the laser light-emitting diode LD pass through an aperture 21*c* and a cylindrical lens 24 arranged between the collimating lens 21*a* and the polygon mirror 26, and are irradiated onto the polygon mirror 26. The LD unit 21 is rotatably fitted to an optical housing (not shown) that holds the polygon mirror 26 and other optical elements that allow the optical beams B to be irradiated onto the photosensitive drum 34 and constitute the optical unit. Further, the LD unit 21 is fitted in a state such that a rotation center axis OS of the LD unit 21 and an optical axis of the optical beams B have a predetermined deviation mainly in the main scanning direction, and the rotation center axis OS of the LD unit 21 and the optical axis of the optical beams are substantially made to match each other at a deflected position of the polygon mirror 26.

Figure 17:
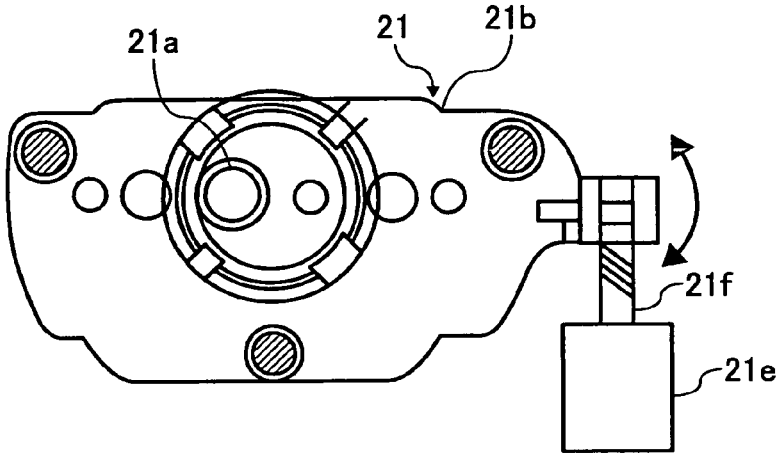
FIG. 17 is a front elevation of the LD unit in FIG. 16.

In the LD unit 21, as shown in FIG. 17, a lead screw 21*f* of a beam-position adjusting motor 21*e* engages with one end of the LD unit 21 in the main scanning direction, so that when the beam-position adjusting motor 21*e* rotates, the lead screw 21*f* also rotates to rotate the LD unit, centering on the rotation center axis OS, as shown by arrow in FIG. 17.

Figure 18:
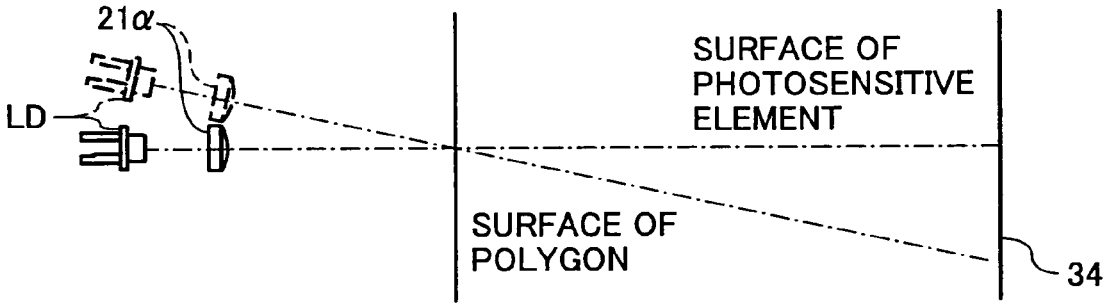
FIG. 18 is a schematic diagram of a displaced state of a beam on a photosensitive element due to rotation of the LD unit.

When the LD unit 21 rotates centering on the rotation center axis OS, as shown in FIG. 18, the LD unit 21 formed of the laser light-emitting diode LD and the holding member 21*b* for holding the coupling optical system is displaced in the sub scanning direction, thereby shifting the laser irradiation position.

Figure 19:
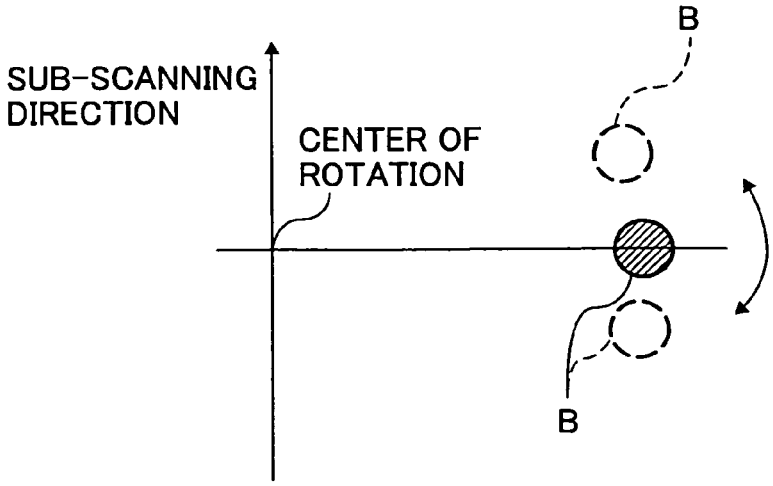
FIG. 19 is a schematic diagram of a shifted state of the beam in a sub scanning direction on the photosensitive element due to rotation of the LD unit.

As a result, as shown in FIG. 19, the optical beam B emitted from the laser light-emitting diode LD moves in the sub scanning direction, centering on the center of rotation on the photosensitive drum 34, thereby displacing the beam irradiation position.

Thus, by allowing the LD unit 21 to rotate about the rotation center axis OS, repetition stability can be improved, thereby enabling highly accurate correction of color misalignment.

Inclination of the scanning lines in the single color images of respective colors changes due to an installing state of the entire apparatus and the environment and temperature changes, thereby causing color misalignment in the sub scanning direction.

Figure 20:
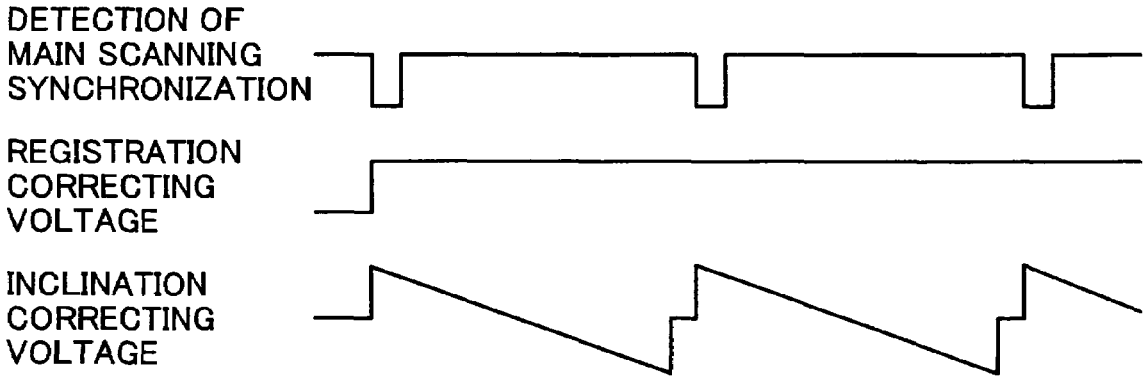
FIG. 20 depicts a pattern of voltage applied to a deflecting element that corrects inclination of a scanning line of a single color image.

According to a conventional correction method, color misalignment detection patterns are created in a plurality of rows (at least two rows) on the intermediate transfer belt, color misalignment due to the inclination between respective colors is measured by a plurality of photosensors corresponding to the positions thereof to calculate an inclination amount with respect to the reference color, and based on the calculated amount, the inclination of the beams is corrected by the color-misalignment correcting unit. More specifically, the inclination amount is designated as a correction amount for each color, and based on the amount, a voltage to be applied to the deflecting element is determined. The voltage waveform changes during scanning of one line as shown in FIG. 20, and the inclination of the beams is corrected by repetitively supplying the voltage to the deflecting element, using a main scanning synchronization detection signal as a trigger.

According to the present invention, the beam-spot position detectors 300*a* and 300*b* shown in FIG. 2 are used as the inclination detector, instead of the photosensor, and the inclination of the beams is corrected by the color-misalignment correcting unit based on the detection result. In other words, the inclination of the single color image is determined based on two misalignment amounts respectively detected by the beam-spot position detectors 300*a* and 300*b*, and correction is performed according to the inclination amount.

Alternatively, before the color misalignment pattern is formed, positions in the sub scanning direction of beams emitted from the optical scanning device are measured at the scanning start end and rear end by using the beam-spot position detectors 300*a* and 300*b*, the target beam positions at the scanning start end and rear end are calculated, using an inclination amount obtained by measuring the color misalignment detection pattern by the photosensor as the correction amount, and are stored in the memory. In the normal print operation, a correction voltage shown in FIG. 20 can be applied to the respective deflecting elements so as to achieve the target beam positions, using the synchronization detection signal as the trigger. In this case, inclination changes due to temperature rise inside of the apparatus at the time of continuous printing or due to environmental changes can be handled.

Figure 21:
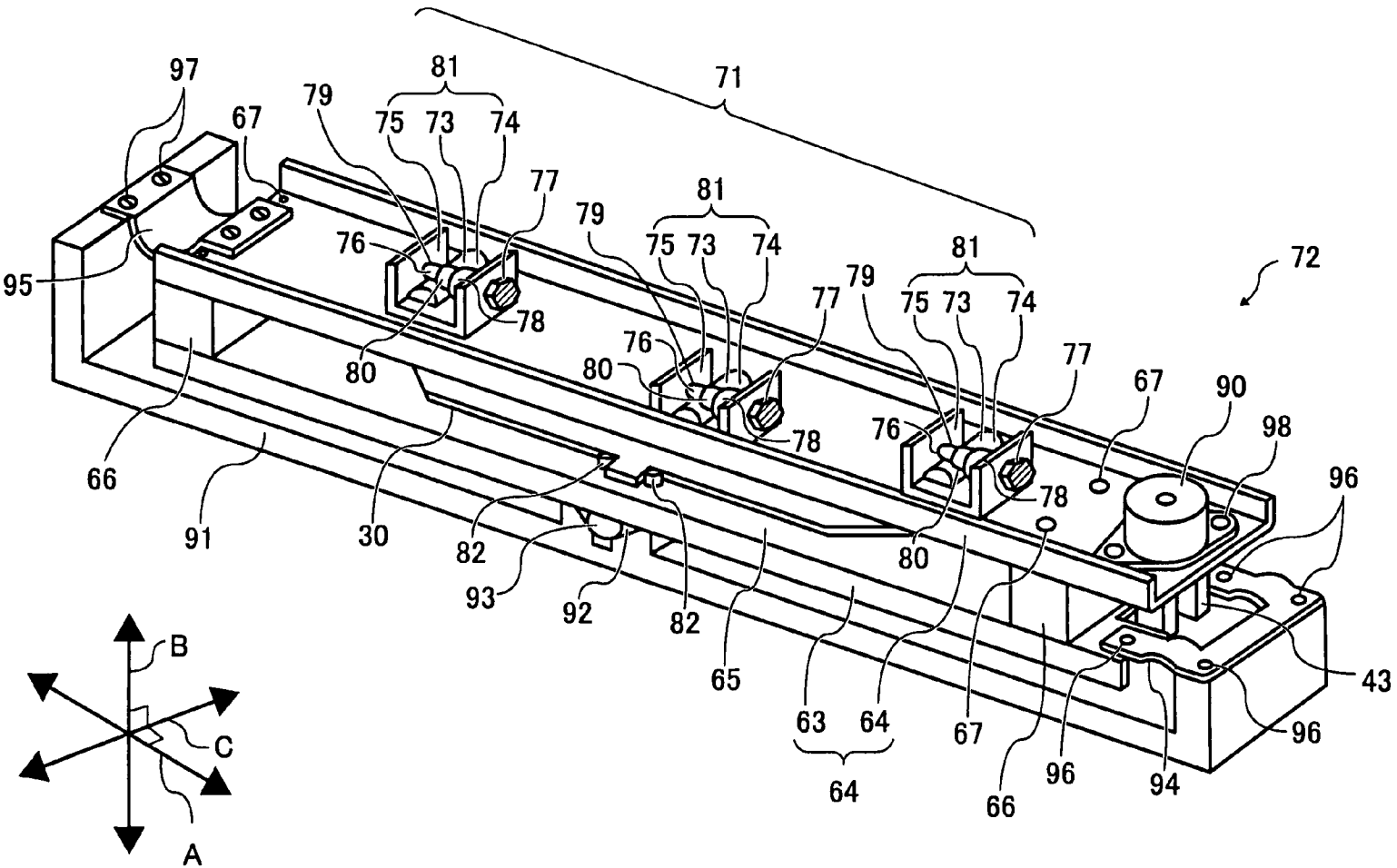
FIG. 21 is a perspective view of the relevant parts of the optical scanning device, including a scanning-line-inclination correcting unit, which is a color-misalignment correcting unit.
Figure 22:
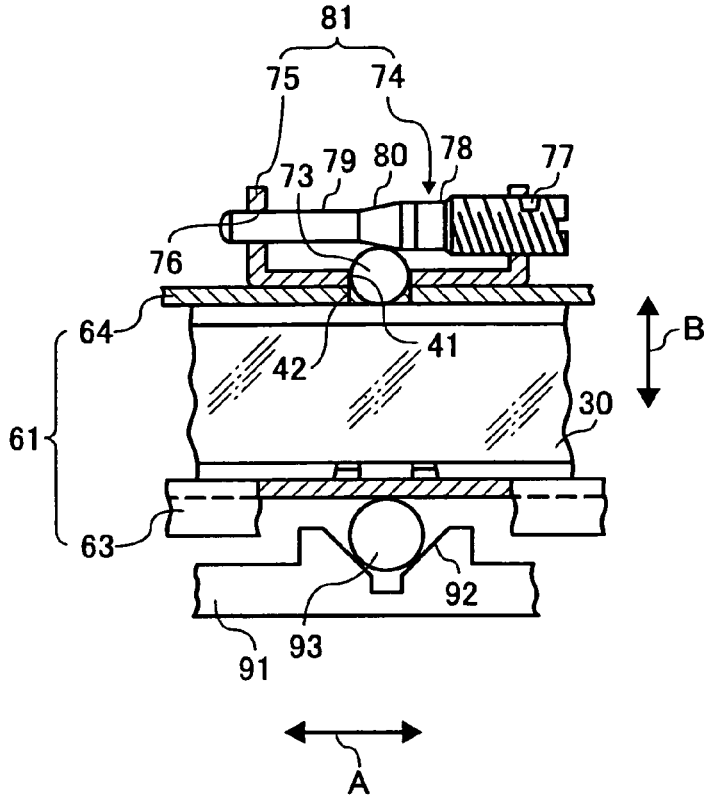
FIG. 22 is an elevational cross-sectional view of the relevant parts shown in FIG. 21.
Figure 23:
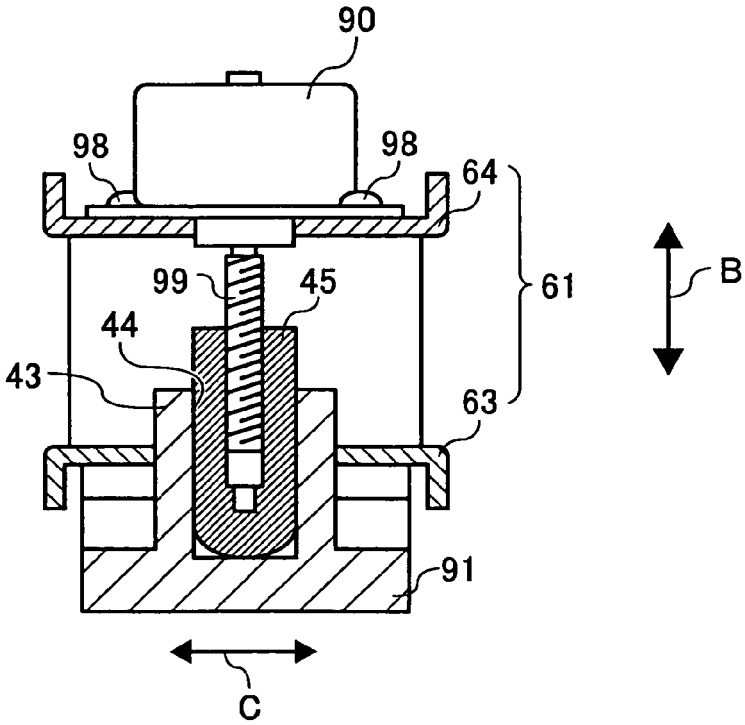
FIG. 23 is a side cross-sectional view of the relevant parts shown in FIG. 21.

FIGS. 21 to 23 depict a configuration example (4) of the color-misalignment correcting unit for correcting an inclination of the scanning lines.

This configuration uses a color-misalignment correcting unit disclosed in Japanese Patent Application Laid-Open No. 2004-287380. As shown in FIG. 21, the optical scanning device 20 includes a scanning-line-curvature correcting unit 71 that corrects a curvature of the scanning lines on the photosensitive drum 34 due to the beams by correcting the second scanning lens 30 in the sub scanning direction B, and a scanning-line-inclination correcting unit 72 as the color-misalignment correcting unit that corrects the inclination of the scanning lines on the photosensitive drum 34 due to the beams by inclining the entire second scanning lens 30.

A part of members constituting the scanning-line-curvature correcting unit 71 and a part of members constituting the scanning-line-inclination correcting unit 72 are provided integrally with the holding member 61. The scanning-line-curvature correcting unit 71 and the scanning-line-inclination correcting unit 72 are arranged with respect to the second scanning lens 35 separately in the same manner, and a part of members constituting these units is provided integrally with the holding member 62, as with respect to the holding member 61.

The holding member 61 has a support member 63 long in the main scanning direction A that supports the second scanning lens 30 from the sub scanning direction B, and a clamping member 64 that clamps the second scanning lens 30 between the support member 63 and the clamping member 64. The support member 63 has a reference surface 65 that abuts against the held second scanning lens 30 to form a position reference of the second scanning lens 30 in the holding member 61.

The support member 63 and the clamping member 64 are respectively a sheet metal, whose section is bent in a U-shape to improve flexural strength, and the plane thereof is made to abut against the second scanning lens 30. In the support member 63, the plane abutting against the second scanning lens 30 forms the reference surface 65. The second scanning lens 30 is fixed by the support member 63 on the reference surface 65, with a part thereof being clamped by pins 82 provided in a protruding manner on the reference surface.

At the opposite ends of the support member 63 and the claming member 64 in the longitudinal direction of the second scanning lens 30, that is, in the direction A, a square pillar 66 having substantially the same height as the thickness of the second scanning lens 30 is arranged for holding a gap between the support member 63 and the claming member 64. The support member 63 and the square pillar 66, and the claming member 64 and the square pillar 66 are respectively fastened by screws 67, in a state that the second scanning lens 30 is clamped between the support member 63 and the claming member 64. Respective square pillars 66 constitute the holding member 61 together with the support member 63 and the claming member 64. In FIG. 21, only the screws 67 that fasten the clamping member 64 and the square pillar 66 are shown. Explanations of the scanning-line-curvature correcting unit 71 are omitted.

As shown in FIG. 21, the scanning-line-inclination correcting unit 72 has a stepping motor 90, which is an actuator as a holding member-inclining unit and a driving unit provided integrally with the clamping member 64 for driving the holding member 61 so as to incline, an inclination detector (not shown) that detects inclination of the scanning line, and a central processing unit (CPU) as a controller (not shown) that makes the holding member 61 incline by the stepping motor according to the inclination corresponding to the misalignment amount of the scanning line detected by the inclination detector, thereby to incline the entire second scanning lens 30 and correct the inclination of the scanning line.

In FIG. 21 or 22, reference numeral 91 denotes a long lens holder as an immovable member for supporting the holding member 61 integrally formed with a housing (not shown) of the optical scanning device 20. The immovable member can be the housing itself of the optical scanning device 20. The long lens holder 91 has a V groove 92 arranged so as to extend in a direction C, corresponding to the center of the second scanning lens 30 in the direction A.

The scanning-line-inclination correcting unit 72 has a roller 93 as a fulcrum member long in the direction C, placed on the V groove 92. The holding member 61 is supported by the long lens holder 91 so as to be displaceable, more specifically, swingable in a direction capable of correcting the inclination of the scanning line via the roller 93. Accordingly, an abutting portion of the roller 93 and the holding member 61 forms a fulcrum 47 at the time of inclining the holding member 61. The fulcrum 47 is located at the central position of the second scanning lens 30 in the direction A and near the optical axis of the second scanning lens 30.

If the long lens holder 91 supports the holding member 61 only via the roller 93, the holding member 61 becomes unstable. Therefore, the scanning-line-inclination correcting unit 72 has a plate spring 94 as a resilient member integrally formed with the support member 63 and the long lens holder 91, and a plate spring 95 as a resilient member integrally formed with the clamping member 64 and the long lens holder 91. Accordingly, the holding member 61 is supported swingably in the direction capable of correcting the inclination of the scanning line with respect to the long lens holder 91, and pressed against the roller 93 due to the resilience of the plate springs 94 and 95, so as to be supported stably with respect to the long lens holder 91.

The plate spring 94 is integrally formed with the support member 63 and the long lens holder 91 by screws 96, and the plate spring 95 is integrally formed with the clamping member 64 and the long lens holder 91 by screws 97. As shown in FIG. 21 or 23, the stepping motor 90 is integrally formed with the clamping member 64 by screws 98.

As shown in FIG. 23, the stepping motor 90 has a stepping motor shaft 99. A protrusion 43 is provided in a protruding manner on the upper surface of the long lens holder 91, and a nut 45 having a spherical end and an oval-shaped cross section is fitted into a groove 44 formed inside of the protrusion 43. An external screw is cut on the stepping motor shaft 99, and the end thereof engages with the nut 45. The nut 45 is fixed by engagement with, the groove 44, and immovable even at the time of rotation of the stepping motor shaft 99.

The CPU calculates the number of steps for driving the stepping motor 90 based on the misalignment amount of the scanning line detected by the beam-spot position detectors 300*a* and 300*b* as the inclination detector, and drives the stepping motor 90. A test pattern is timely formed, so as to be used for the feedback control performed by the CPU based on a detection signal of the inclination detector.

Since the scanning-line-inclination correcting unit 72 has the above configuration, when the CPU drives the stepping motor 90 based on the detection results by the beam-spot position detectors 300*a* and 300*b* (relative dot misalignment in the sub scanning direction in FIG. 4, that is, sub scanning correction amount $\Delta Z$) to rotate the stepping motor shaft 99, the holding member 61 is displaced with respect to the long lens holder 91 against an energizing force of the plate springs 94 and 95, $\gamma$-rotates centering on the fulcrum 47, and inclines. Since the CPU performs feedback control for driving the stepping motor 90 based on the detection result obtained by the detectors, misalignment of the scanning line, more specifically, the inclination of the scanning line can be quickly solved.

In the optical scanning device 20, one color of the four colors, Y (yellow), M (magenta), C (cyan), and K (black) is used as a reference, and the scanning positions of the scanning beams by the scanning optical systems for colors other than the reference color are corrected so as to make the scanning positions substantially match the scanning position of the reference color. In other words, the scanning lines of the beams corresponding to non-reference colors are made to match the scanning line of the beam corresponding to the reference color. It is because by correcting relative positions of the scanning lines, an image having excellent color reproducibility can be obtained, with tone fluctuations being sufficiently suppressed. As a result, the scanning-line-curvature correcting unit 71 and the scanning-line-inclination correcting unit 72 need to be arranged so as to adjust three scanning beams among respective scanning beams of Y (yellow), M (magenta), C (cyan), and K (black), hence the number of these correcting units needs only to be three, respectively. It is preferred to designate black as the reference color in this configuration.

Figure 24:
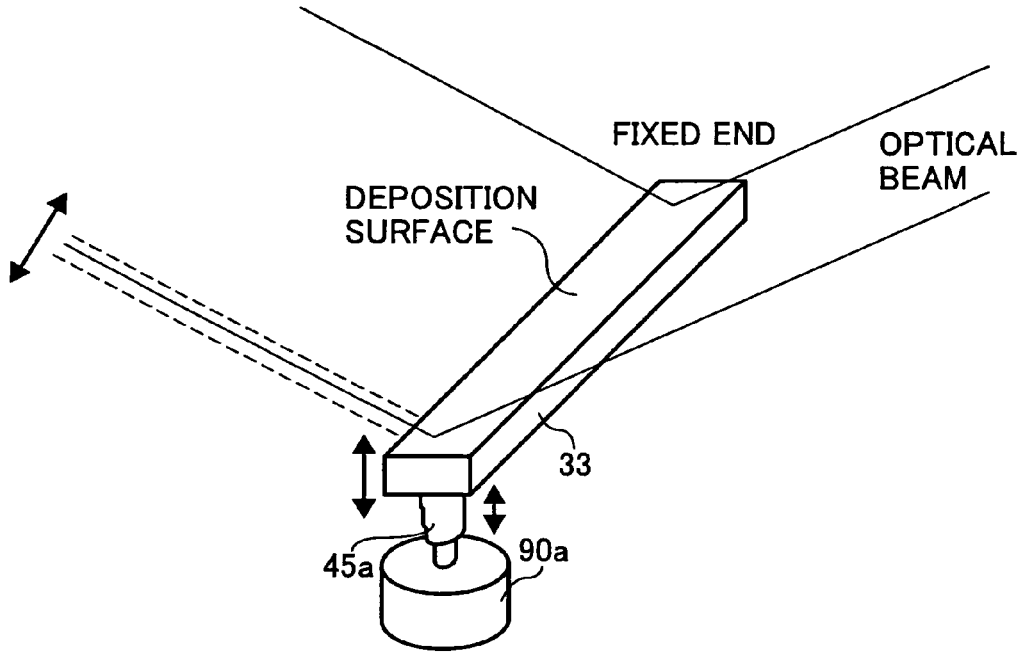
FIG. 24 is a schematic diagram of another example of the scanning-line-inclination correcting unit, which is a color-misalignment correcting unit.

FIG. 24 depicts a configuration example (5) of the color-misalignment correcting unit for correcting the inclination of the scanning lines.

At a fitting position of a long imaging element (any one of the folding mirrors 23, 31, 32, and 33 (or 36 or 37) that guides the optical beam scanned in the main scanning direction by the polygon mirror to the photosensitive element, one end thereof is fixed, and the other end is a position-adjustable portion. At the position-adjustable portion, as shown in FIG. 24, a position-fixed motor (stepping motor) 90*a* is a motor driving shaft having a threaded portion on the shaft, and a non-rotatable adjuster 45*a* having a threaded portion inside thereof supports the folding mirror 33. By driving the motor 90*a*, the adjuster 45*a* moves in a direction of motor shaft, to change the attitude angle of the folding mirror 33. Accordingly, the inclination of the optical beam on the photosensitive drum 34 can be adjusted.

The configuration for correcting the relative deviation in the sub scanning direction or inclination of single color images of respective colors has been explained above. However, magnification deviations in the main scanning direction of single color images of respective colors can be also corrected in the configuration including the beam detectors (beam-spot position detectors 300*a* and 300*b*) and the color-misalignment correcting unit. In other words, magnification deviations in the main scanning direction of single color images are obtained based on two misalignment amounts detected by the beam-spot position detectors 300*a* and 300*b*, to perform correction according to the magnification deviation amount.

Fitting of the beam detectors to the housing of the optical scanning device is explained next.

At the time of fitting the beam detectors (beam-spot position detectors 300*a* and 300*b*), it is very important that the beam detector itself does not change the position or relatively change the position.

Figure 25:
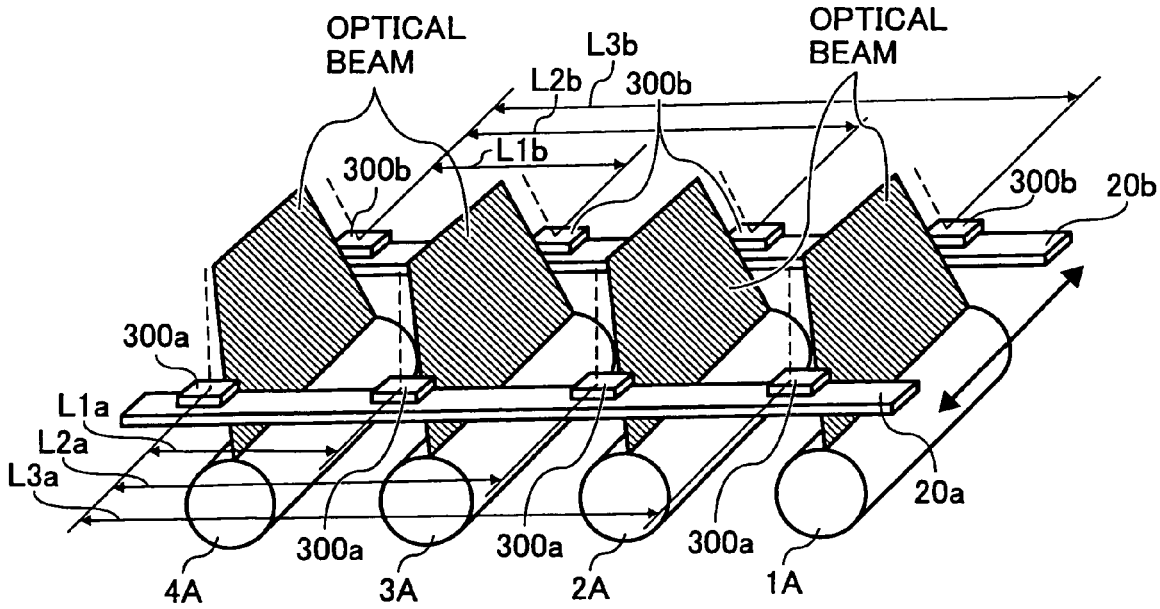
FIG. 25 is a schematic diagram of a fitting example (1) of the beam detectors.

FIG. 25 is a fitting example (1) of the beam detectors (beam-spot position detectors 300*a* and 300*b*). Regarding the beam-spot position detectors 300*a* on the front end side and the beam-spot position detectors 300*b* on the rear end side provided for each color, four beam-spot position detectors 300*a* are positioned and arranged on one holding member

20*a*, and four beam-spot position detectors 300*b* are positioned and arranged on one holding member 20*b*.

It is desired to use the same material (for example, a metal containing iron) for the holding member 20*a* on the front end side and the holding member 20*b* on the rear end side, since the coefficient α of linear expansion becomes the same. Furthermore, it is better to have smaller coefficient α of linear expansion.

In other words, when it is assumed that a distance between the beam-spot position detector 300*a* for the reference color and the beam-spot position detector 300*a* for a certain color is La, a distance between the beam-spot position detector 300*b* for the reference color and the beam-spot position detector 300*b* for the certain color is Lb, and a distance between the beam-spot position detectors 300*a* and 300*b* for the same color is s, even if a temperature change occurs in the beam-spot position detector 300*b*, the inclination amount of the beam detector y=(Lb−La)/s becomes as $$y'=\{(Lb+Lb*\alpha)-(La+La*\alpha)\}/s=(Lb-La)/s+(Lb-La)*\alpha/s$$

In this equation, the second member is α<<1, and becomes a negligible value by reducing a deviation of the initial distance between La and Lb (for example, by adjusting the inclination of the optical beams with a correct jig and adjusting the detector to the initial position). Since the position change of the beam detector can be ignored, the inclination of the optical beams can be accurately measured.

Figure 26:
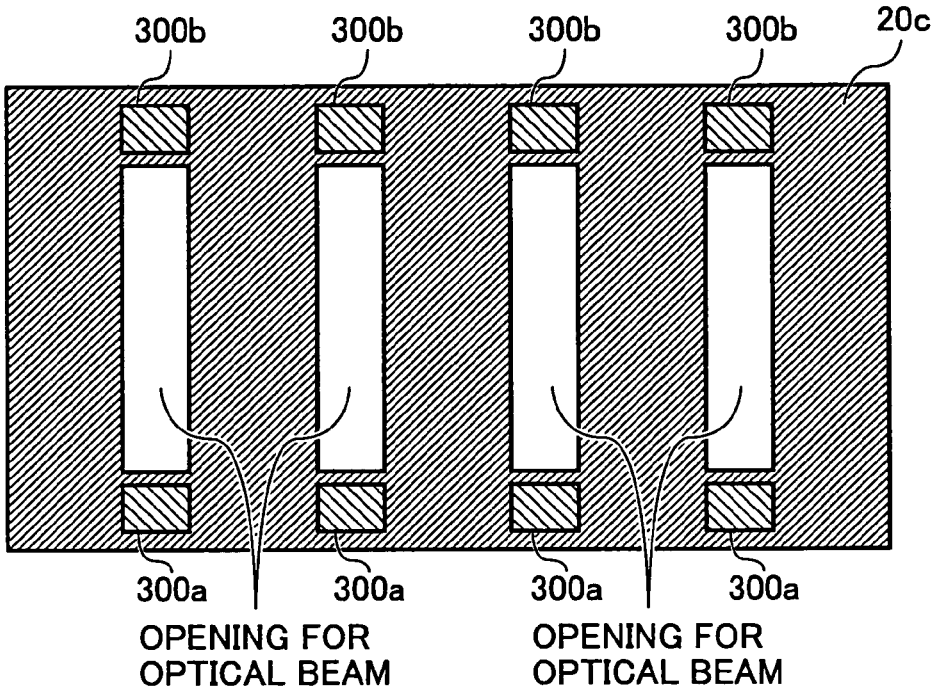
FIG. 26 is a schematic diagram of a fitting example (2) of the beam detectors.

FIG. 26 is a fitting example (2) of the beam detectors (beam-spot position detectors 300*a* and 300*b*). Regarding the beam-spot position detectors 300*a* on the front end side and the beam-spot position detectors 300*b* on the rear end side provided for each color, all of four beam-spot position detectors 300*a* and four beam-spot position detectors 300*b* are positioned and arranged on one holding member 20*c*. According to the present embodiment, since the position change of the beam detectors can be ignored as well, the inclination of the optical beams can be measured with high accuracy. The holding member 20*c* also functions as a cover for covering an opening of the housing for holding the optical elements, and a transmission glass can be arranged on the opening for the optical beams.

Figure 27:
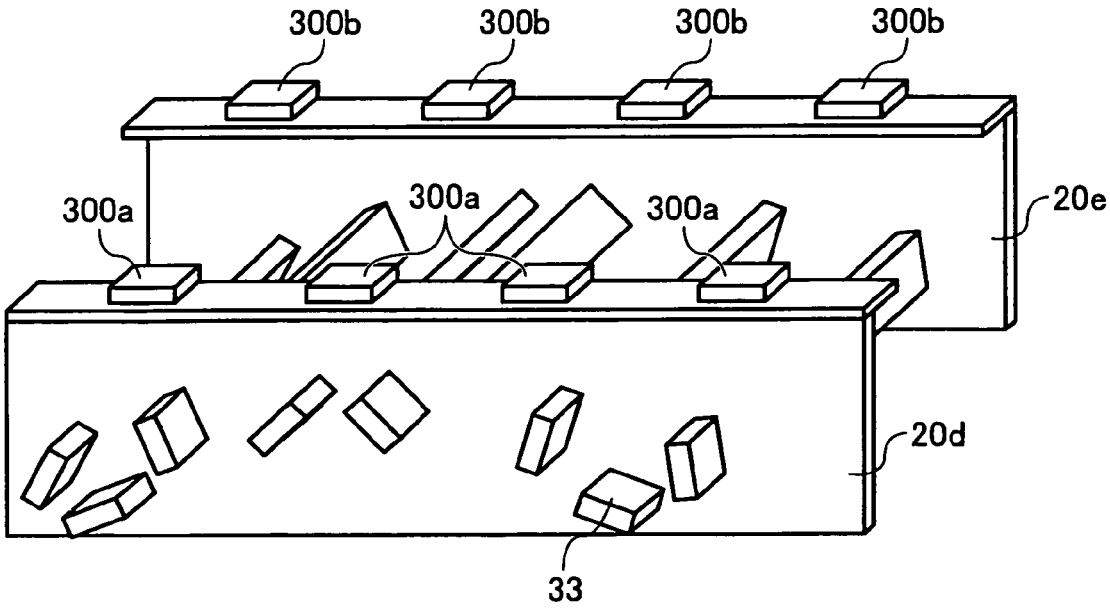
FIG. 27 is a schematic diagram of a fitting example (3) of the beam detectors.

FIG. 27 is a fitting example (3) of the beam detectors (beam-spot position detectors 300*a* and 300*b*). Regarding the beam-spot position detectors 300*a* on the front end side and the beam-spot position detectors 300*b* on the rear end side provided for each color, four beam-spot position detectors 300*a* are positioned and arranged on one holding member 20*d*, and four beam-spot position detectors 300*b* are positioned and arranged on one holding member 20*e*. The holding members 20*d* and 20*e* respectively have a bent portion, to hold the folding mirror 33 and the like by the respective bent portions of the holding members 20*d* and 20*e*. As a result, changes in the inclination amount of the beam detectors on the front end and the rear end due to a temperature change can be reduced, and an inclination change of the folding mirror can be reduced.

According to an embodiment of the present invention, synchronization in the sub scanning direction can be achieved with high accuracy by detecting scanning synchronization of optical beams in a state where the optical beams have passed optical elements that are identical to an actual image. Further, by arranging the beam detectors outside an effective scanning area on the scanning line of the optical beam, the position of the optical beam can be detected at all times.

Furthermore, according to an embodiment of the present invention, in addition to the above effect, the apparatus can be made small and simplified at a low cost. Further, correction of color misalignment at the time of forming an image can be performed by the optical scanning device both in the horizontal and sub scanning directions. Accordingly, it is not necessary to use a method of forming a toner mark on the intermediate transfer belt or the like, which has been heretofore used widely, and hence deterioration of detection accuracy due to deterioration of the belt (image carrier) or the like does not need to be taken into consideration.

Moreover, according to an embodiment of the present invention, relative deviation in the sub scanning direction of a single color image for each optical beam (for each color) (misalignment of a target single color image with respect to the single color image of the reference color) can be corrected.

Furthermore, according to an embodiment of the present invention, registration of a target single color image can be performed by performing correction in a unit of one scan of the deflector.

Moreover, according to an embodiment of the present invention, registration of a single color image can be performed with higher accuracy, by performing correction in a unit of resolution finer than one scan of the deflector.

Furthermore, according to an embodiment of the present invention, a deviation of the beam position can be measured at respective positions on the upstream side and the downstream side in the main scanning direction on the scanning line of the optical beam. Accordingly, not only the relative deviation of the single color image but also inclination of the scanning line can be detected.

Moreover, according to an embodiment of the present invention, registration of the single color image can be performed.

Furthermore, according to an embodiment of the present invention, since one of the beam detectors detects misalignment of the optical beam, and then the other detects misalignment of the optical beam, inclination of the single color image can be detected from a misalignment difference between the two beam detectors, thereby enabling more accurate misalignment correction. By using an optical element having a fulcrum that is displaced when a stress is applied in a predetermined direction as the color-misalignment correcting unit, inclination of the single color image can be corrected easily. Further, if a motor is used as a unit that applies the stress in the predetermined direction, the correction amount can be obtained by energizing the motor for a turning angle corresponding to the time difference, thereby enabling automatic inclination correction at any time.

Moreover, according to an embodiment of the present invention, synchronization in the main scanning direction can be achieved with high accuracy by detecting synchronization of optical beams in a state where the optical beams have passed optical elements that are identical to an actual image.

Furthermore, according to an embodiment of the present invention, a deviation of the beam position can be measured at respective positions on the upstream side and the downstream side in the main scanning direction on the scanning line of the optical beam. As a result, magnification deviation of single color images can be detected based on misalignment at respective positions, thereby enabling magnification adjustment.

Moreover, according to an embodiment of the present invention, an image forming apparatus that outputs a color image, with which color misalignment is accurately corrected, can be provided.

Furthermore, according to an embodiment of the present invention, at the time of forming a color image, color misalignment in a sub scanning direction can be accurately corrected.

Moreover, according to an embodiment of the present invention, at the time of forming a color image, color misalignment in a main scanning direction can be accurately corrected.

Furthermore, according to an embodiment of the present invention, a color image can be corrected and output accurately.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical scanning device for an image forming apparatus that forms a color image by combining a plurality of single color images formed on a plurality of photosensitive elements, the optical scanning device comprising:

a plurality of light sources each of which emits an optical beam;

a deflecting unit that deflects the optical beams from the light sources;

a plurality of optical elements provided for each of the optical beams, sequentially arranged between the deflecting unit and the photosensitive elements, to guide the optical beams deflected by the deflecting unit to the photosensitive elements;

a pair of beam detecting units provided for each of the optical beams for detecting at least one of a position of the optical beam in a sub scanning direction and a position of the optical beam in a main scanning direction, the pair of beam detecting units including a first beam detecting unit and a second beam detecting unit; and a color-misalignment correcting unit provided for each of the optical beams for changing an optical-beam irradiating position on each of the corresponding photosensitive elements based on a result of detection by the corresponding pair of beam detecting units, wherein the pair of beam detecting units being, arranged between the optical element that is closest to the corresponding photosensitive element and the corresponding photosensitive element, integrally fitted to a housing of the optical scanning device, fixed between holding members that hold the optical scanning device and a dustproof glass through which the corresponding optical beam is transmitted, and arranged on a scanning line of the corresponding optical beam so that the corresponding optical beam outside an effective image area enters the pair of beam detecting units, and each first beam detecting unit being placed at a position on one of the holding members and each second beam detecting unit being placed at a position on another of the holding members.

2. The optical scanning device according to claim 1, wherein the pair of beam detecting units includes, a light-receiving element provided at least one position on a scanning line of the optical beam, and a measuring unit that measures an amount of misalignment of the optical beam in the sub scanning direction in the light-receiving element; and the color-misalignment correcting unit corrects a relative deviation of the corresponding single color image in the sub scanning direction based on the amount of misalignment measured by the measuring unit.

3. The optical scanning device according to claim 2, wherein the color-misalignment correcting unit corrects the relative deviation of the single color image in the sub scanning direction per scan of the deflecting unit, start and end of the scan being measured by the pair of beam detecting units.

4. The optical scanning device according to claim 3, wherein the color-misalignment correcting unit corrects the relative deviation of the single color image in the sub scanning direction more frequently than the correction per scan.

5. The optical scanning device according to claim 1, wherein the pair of beam detecting units includes, light-receiving elements provided at an upstream side and an downstream side on a scanning line of the optical beam, and a measuring unit that measures an amount of misalignment of the optical beam in the sub scanning direction in each of the light-receiving elements.

6. The optical scanning device according to claim 5, wherein the color-misalignment correcting unit obtains a relative-deviation correction amount for the corresponding single color image in the sub scanning direction based on an average of the amounts of misalignment measured by the measuring unit.

7. The optical scanning device according to claim 5, wherein the color-misalignment correcting unit corrects an inclination of the corresponding single color image based on the amounts of misalignment measured by the measuring unit.

8. The optical scanning device according to claim 1, wherein the pair of beam detecting units includes, light-receiving elements provided at an upstream side and an downstream side on a scanning line of the optical beam, and a measuring unit that measures an amount of misalignment of the optical beam in the main scanning direction in each of the light-receiving elements.

9. The optical scanning device according to claim 8, wherein the color-misalignment correcting unit corrects a magnification deviation of the corresponding single color image in the main scanning direction based on the amount of misalignment measured by the measuring unit.

10. An Image forming apparatus comprising:

a plurality of photosensitive elements on each of which an electrostatic latent image is formed by optical scanning;

an optical scanning device that includes, a plurality of light sources each of which emits an optical beam, a deflecting unit that deflects the optical beams from the light sources, a plurality of optical elements provided for each of the optical beams, sequentially arranged between the deflecting unit and the photosensitive elements, to guide the optical beams deflected by the deflecting unit to the photosensitive elements, a pair of beam detecting units provided for each of the optical beams for detecting at least one of a position of the optical beam in a sub scanning direction and a position of the optical beam in a main scanning direction, the pair of beam detecting units including a first beam detecting unit and a second beam detecting unit, the pair of beam detecting units being, arranged between the optical element that is closest to the corresponding photosensitive element and the corresponding photosensitive element, integrally fitted to a housing of the optical scanning device, fixed between holding members that hold the optical scanning device and a dustproof glass through which the corresponding optical beam is transmitted, and arranged on a scanning line of the corresponding optical beam so that the corresponding optical beam outside an effective image area enters the pair of beam detecting units, each first beam detecting unit being placed at a position on one of the holding members and each second beam detecting unit being placed at a position on another of the holding members, and a color-misalignment correcting unit provided for each of the optical beams for changing an optical-beam irradiating position on each of the corresponding photosensitive elements based on a result of detection by the corresponding pair of beam detecting units;

a developing unit that develops the electrostatic latent image formed on each of the photosensitive elements as a toner image;

a transfer unit that transfers the toner image onto a recording medium; and a fixing unit that fixes the toner image formed on the recording medium.

11. An optical-scanning correcting method for an optical scanning device that is used in an image forming apparatus that forms a color image by combining a plurality of single color images formed on a plurality of photosensitive elements, the optical scanning device including a plurality of light sources each of which emits an optical beam, a deflecting unit that deflects the optical beams from the light sources, a plurality of optical elements provided for each of the optical beams, sequentially arranged between the deflecting unit and the photosensitive elements, to guide the optical beams deflected by the deflecting unit to the photosensitive elements, and a pair of beam detecting units including a first beam detecting unit and a second beam detecting unit provided for each of the optical beams for detecting at least one of a position of the optical beam in a sub scanning direction and a position of the optical beam in a main scanning direction, the pair of beam detecting units being, arranged between the optical element that is closest to the corresponding photosensitive element and the corresponding photosensitive element, integrally fitted to a housing of the optical scanning device, fixed between holding members that hold the optical scanning device and a dustproof glass through which the corresponding optical beam is transmitted, and arranged on a scanning line of the corresponding optical beam so that the corresponding optical beam outside an effective image area enters the pair of beam detecting units, and each first beam detecting unit being placed at a position on one of the holding members and each second beam detecting unit being placed at a position on another of the holding members, the optical-scanning correcting method comprising:

providing a color-misalignment correcting unit for each of the optical beams; and changing an optical-beam irradiating position on each of the corresponding photosensitive elements based on a result of detection by the corresponding beam pair of units.

12. The optical-scanning correcting method according to claim 11, wherein changing the optical-beam irradiating position includes, correcting at least one of a relative deviation of the corresponding single color image in the sub scanning direction and an inclination of the single color image.

13. The optical-scanning correcting method according to claim 11, wherein changing the optical-beam irradiating position includes, correcting a magnification deviation of the corresponding single color image in the main scanning direction.

14. A method of forming an image with an optical-scanning device having a plurality of light sources each of which emits an optical beam, a deflecting unit that deflects the optical beams from the light sources, a plurality of optical elements provided for each of the optical beams, sequentially arranged between the deflecting unit and a plurality photosensitive elements, to guide the optical beams deflected by the deflecting unit to the plurality of photosensitive elements, comprising:

detecting with a pair of detecting units, a misalignment for each of the optical beams based on at least one of a position of the optical beam in a sub scanning direction and a position of the optical beam in a main scanning direction, the pair of detecting units including a first beam detecting unit and a second beam detecting unit, the pair of detecting units being arranged between the optical element that is closest to the corresponding photosensitive element and the corresponding photosensitive element, integrally fitted to a housing of the optical scanning device, fixed between holding members that hold the optical scanning device and a dustproof glass through which the corresponding optical beam is transmitted, and arranged on a scanning line of the corresponding optical beams so that the corresponding optical beam outside an effective image area enters the pair of beam detecting units, and each first beam detecting unit being placed at a position on one of the holding members and each second beam detecting unit being placed at a position on another of the holding members;

correcting a color misalignment based on each detected misalignment;

changing an optical-beam irradiating position on at least one of the plurality of photosensitive elements based on the detected misalignment;

forming a plurality of single color images on the plurality of photosensitive elements by scanning optical beams; and outputting a color image by combining the single color images formed on the plurality of photosensitive elements.

* * * * *